US006240908B1

(12) United States Patent
Hyodo et al.

(10) Patent No.: US 6,240,908 B1
(45) Date of Patent: Jun. 5, 2001

(54) FUEL STORAGE DEVICE DIAGNOSTIC APPARATUS

(75) Inventors: Yoshihiko Hyodo, Gotenba; Hidekazu Sasaki, Susono; Takuya Matsuoka, Susono; Naoya Takagi, Susono, all of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/333,426

(22) Filed: Jun. 15, 1999

(30) Foreign Application Priority Data

Jun. 22, 1998 (JP) ..... 10-174716

(51) Int. Cl.[7] ..... F02M 37/04
(52) U.S. Cl. ..... 123/516; 123/198 D
(58) Field of Search ..... 123/516, 198 D, 123/520, 519, 518, 521

(56) References Cited

U.S. PATENT DOCUMENTS 5,056,493 * 10/1991 Holzer ..... 123/518
5,143,035 * 9/1992 Kayanuma ..... 123/198 D
5,299,544 * 4/1994 Kitamoto et al. ..... 123/520
5,313,925 * 5/1994 Otsuka et al. ..... 123/520
5,497,757 3/1996 Osani .
5,596,971 * 1/1997 Kidokoro ..... 123/516
5,666,924 * 9/1997 Kadota ..... 123/520
5,722,374 * 3/1998 Kidokoro et al. ..... 123/516
5,746,186 * 5/1998 Kidokoro ..... 123/516
5,979,417 * 11/1999 Hyodo et al. ..... 123/516

FOREIGN PATENT DOCUMENTS 3-213652 9/1991 (JP) .
3-260365 11/1991 (JP) .
3-264758 11/1991 (JP) .
4-362264 12/1992 (JP) .
6-147029 5/1994 (JP) .
7-132738 5/1995 (JP) .
8-170568 7/1996 (JP) .
9-5140 1/1997 (JP) .

* cited by examiner

*Primary Examiner*—Carl S. Miller
(74) *Attorney, Agent, or Firm*—Kenyon & Kenyon

(57) ABSTRACT

A diagnostic apparatus for a fuel storage device has a gas introducing passage for introducing gas from a fuel storage device into an intake passage of an internal combustion engine and a shutoff valve that shuts the gas introducing passage. The diagnostic apparatus detects an amount of fuel component introduced into the intake passage via the gas introducing passage when the shutoff valve is in at least one of an open state and a closed state on the basis of the detected amount of fuel component and, upon detecting the presence of the fuel component in the introduced gas, the apparatus diagnoses that the fuel storage device has a fault.

16 Claims, 27 Drawing Sheets

FUEL STORAGE DEVICE DIAGNOSTIC APPARATUS

INCORPORATION BY REFERENCE

The disclosure of Japanese Patent Application No. HEI 10-174716 filed on Jun. 22, 1998, including the specification, drawings and abstract, is incorporated herein by reference in its entirety.

BACKGROUND OF THE INVENTION

1. Field of the Invention

The present invention relates to a fuel tank diagnostic apparatus.

2. Description of the Related Art

If there is a space above the surface of liquid fuel in a fuel tank, fuel evaporates into the space, and fuel vapor may escape from the fuel tank into the atmosphere. Japanese Patent Application Laid-Open No. HEI 7-132738 discloses a fuel tank equipped with an expandable-shrinkable air bag that is expanded or shrunk in accordance with changes in the level of the surface of liquid fuel in the fuel tank so that the air bag always remains in close contact with the surface of liquid fuel.

In the fuel tank disclosed in the Japanese Patent Application Laid-Open No. HEI 7-132738, the interior space of the air bag is in communication with a fuel vapor adsorbing canister so that fuel vapor allowed to permeate through the air bag sheet will not escape to the atmosphere.

If the air bag in the fuel tank as described in Japanese Patent Application Laid-Open No. HEI 7-132738 repeatedly expands and shrinks, a hole may be formed in the air bag material, or the air bag material may come to swell with fuel or may come to allow passage of fuel therethrough. If such an undesired event happens, it is necessary to detect that the fuel tank has a failure. However, the aforementioned conventional fuel tank does not have a function to detect a fault or failure in the fuel tank.

SUMMARY OF THE INVENTION

Accordingly, it is an object of the invention to diagnose whether there is a fault in a partition dividing the interior space of a fuel storage device into a fuel chamber and an air chamber.

In accordance with one aspect of the invention, a fuel storage device diagnostic apparatus includes a gas introducing passage that introduces gas from a fuel storage device into an intake passage of an internal combustion engine, a shutoff valve that shuts the gas introducing passage, a fuel component amount detecting device for detecting an amount of a fuel component supplied to the internal combustion engine when the shutoff valve is in at least one of an open state and a closed state, and a diagnostic device for detecting a fuel component in the gas introduced into the intake passage on the basis of the amount of the fuel component detected by the fuel component amount detecting device, and for diagnosing that the fuel storage device has a fault upon detection of the presence of a predetermined fuel component in the gas. Therefore, the fuel storage device diagnostic apparatus is able to detect whether there is a fuel component in the fuel storage device on the basis of the amount of fuel component introduced into the internal combustion engine when the shutoff valve is in at least one of the open state and the closed state. Hence, if the presence of a fuel component is detected in the fuel storage device when the shutoff valve is in the open state or the closed state, the fuel storage device diagnostic apparatus diagnoses that the fuel storage device has a fault.

In accordance with another aspect of the invention, a fuel storage device diagnostic apparatus includes a fuel storage device having a partition that divides a space in the fuel storage device into a fuel chamber and an air chamber, the partition being deformable in accordance with an amount of fuel present in the fuel chamber, a gas introducing passage that introduces gas from the air chamber into an intake passage of an internal combustion engine, a shutoff valve that shuts the gas introducing passage, a fuel component amount detecting device for detecting an amount of a fuel component supplied to the internal combustion engine when the shutoff valve is in at least one of an open state and a closed state, and a diagnostic device for detecting a fuel component in the gas introduced into the intake passage on the basis of the amount of the fuel component detected by the fuel component amount detecting device, and for diagnosing that the partition has a fault upon detection of the presence of a fuel component in the gas. Therefore, the fuel storage device diagnostic apparatus in accordance with this aspect of the invention diagnoses whether the partition has a fault on the basis of the amount of the fuel component present in the internal combustion engine after the shutoff valve has been opened or closed.

BRIEF DESCRIPTION OF THE DRAWINGS

The foregoing and further objects, features and advantages of the present invention will become apparent from the following description of preferred embodiments with reference to the accompanying drawings, wherein like numerals are used to represent like elements and wherein.

DETAILED DESCRIPTION OF PREFERRED EMBODIMENTS

Preferred embodiments of the fuel storage device diagnostic apparatus of the present invention will be described in detail hereinafter with reference to the accompanying drawings.

Figure 1:
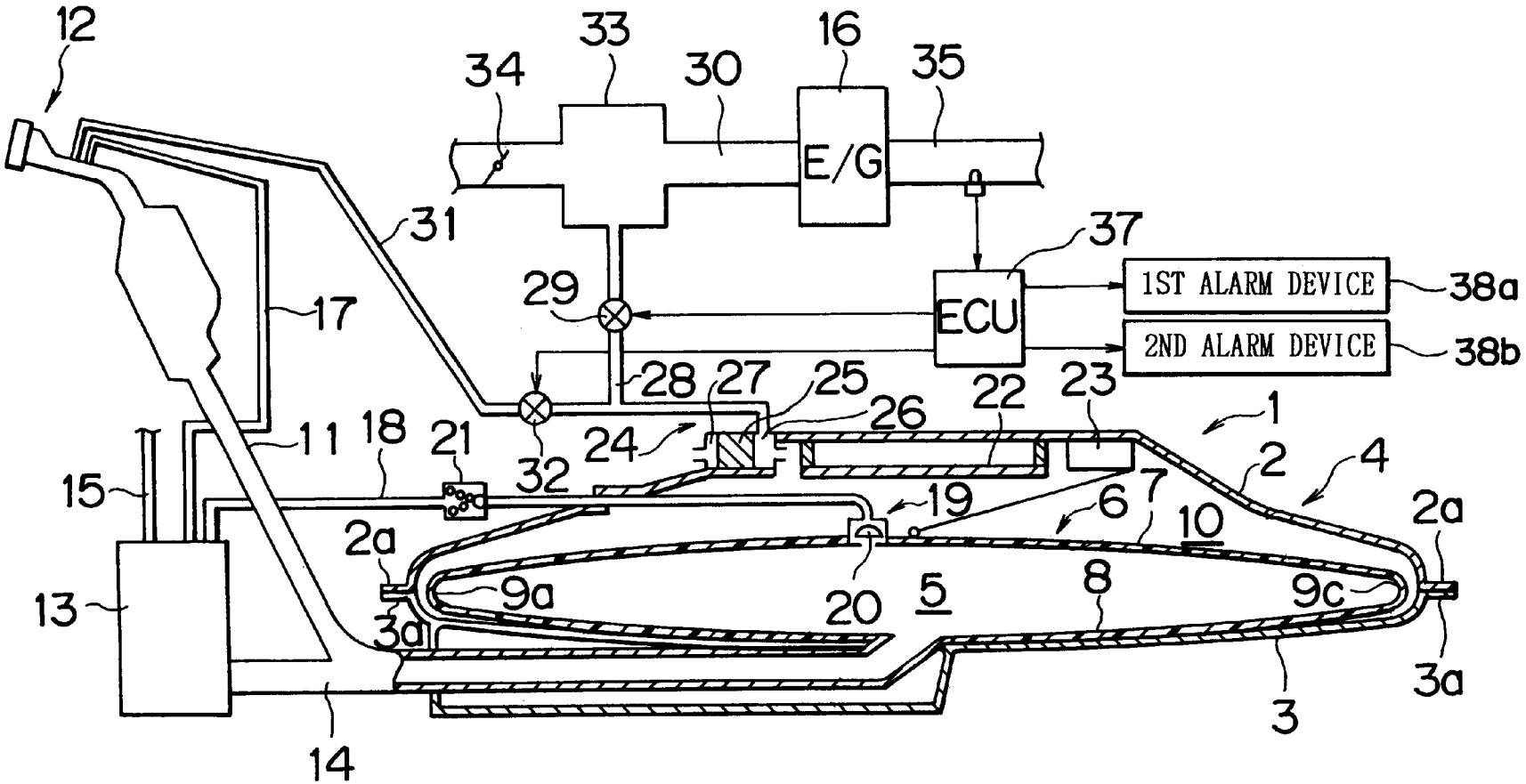
FIG. 1 illustrates a fuel storage device according to a first embodiment of the invention.

A fuel storage device according to a first embodiment of the invention will be described. A fuel storage device 1 shown in FIG. 1 is used as, for example, a tank for storing fuel that is to be supplied to an internal combustion engine. The fuel storage device 1 may also be used as a tank for merely storing fuel. The fuel storage device 1 has a housing 4 that is substantially made up of a generally cup-shaped upper portion 2 and a generally cup-shaped lower portion 3. The upper portion 2 and the lower portion 3 are joined at their flanges 2*a*, 3*a* formed around their peripheries. The housing 4 contains a fuel container or fuel tank 6 that defines a fuel chamber 5 therein for storing fuel.

Figure 2:
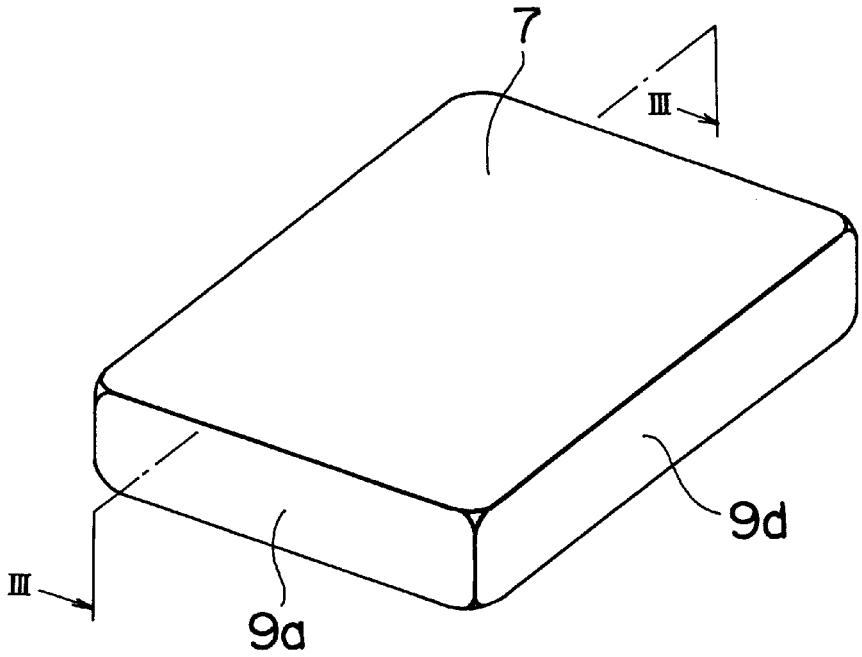
FIG. 2 is a perspective view of a fuel tank according to the first embodiment.
Figure 3:
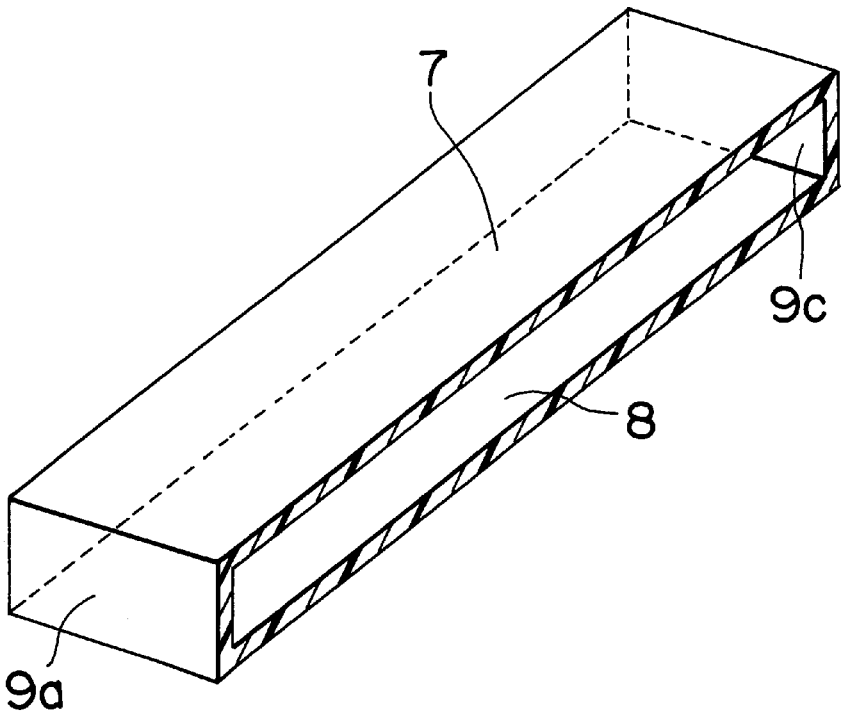
FIG. 3 is a sectional perspective view of the fuel tank taken on a plain III—III in FIG. 2.

Referring to FIGS. 2 and 3, the fuel tank 6 in the first embodiment has a generally rectangular upper wall 7 and a generally rectangular lower wall 8 that are disposed in a vertical relationship to each other, and generally rectangular four side walls 9*a*–9*d* (side wall 9*d* is not shown) that connect the corresponding sides of the upper and lower walls 7, 8. Each of the side walls 9*a*–9*d* is connected at its opposite edges to adjacent side walls. The fuel tank 6 thus has a generally rectangular parallelepiped shape, and defines the fuel chamber 5 therein. Therefore, each wall of the fuel tank 6 corresponds to a partition that divides the interior space of the fuel storage device 1 into the fuel chamber 5 and an air chamber 10. Each of the upper and lower walls 7, 8 and the side walls 9*a*–9*d* has a multi-layer structure formed by covering the opposite surfaces of a flat core portion formed from a nylon or a copolymer resin of ethylene and vinyl, with skin portions formed from a high-density polyethylene. The upper and lower walls 7, 8 and the side walls 9*a*–9*d* are substantially rigid.

The area of each of the upper wall 7 and the lower wall 8 of the fuel tank 6 is larger than the area of one of the side walls 9*a*–9*d*. The rigidity of the upper and lower walls 7, 8 is lower than the rigidity of the side walls 9*a*–9*d*. The general shape of the upper and lower walls 7, 8 is not limited to a rectangle, but may also be any other polygon. That is, the shapes of the upper and lower walls 7, 8 and the side walls 9*a*–9*d* may be suitably selected in accordance with the shape of a space in which the fuel tank 6 is disposed.

Figure 4:
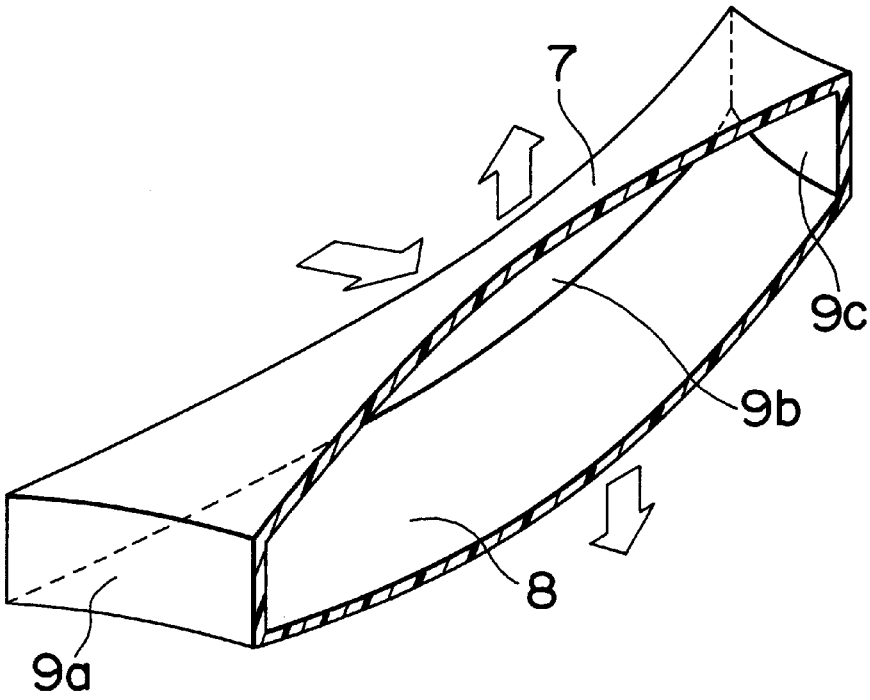
FIG. 4 is a sectional perspective view of the fuel tank taken in a manner similar to that in FIG. 3, wherein the fuel tank is expanded.

As shown in FIG. 4, when fuel is supplied into the fuel tank 6 in an amount exceeding a normal maximum amount of fuel that can be stored in the fuel tank 6 while the generally rectangular parallelepiped shape of the fuel tank 6 is retained (hereinafter, referred to as "predetermined amount"), the upper wall 7 and the lower wall 8 curve or expand outwards so as to separate from each other, and the side walls 9*a*–9*d* curve or sink inwards so as to come closer to one another. That is, in the first embodiment, when the amount of fuel in the fuel tank 6 exceeds the predetermined amount, the upper wall 7 and the lower wall 8 are displaced upwards and downwards, respectively, and the side walls 9*a*–9*d* are displaced horizontally inwards. In this manner, the amount of fuel storable in the fuel tank 6 gradually increases. The amount of deformation of the upper and lower walls 7, 8 is normally greater than the amount of deformation of the side walls 9*a*–9*d*.

Figure 5:
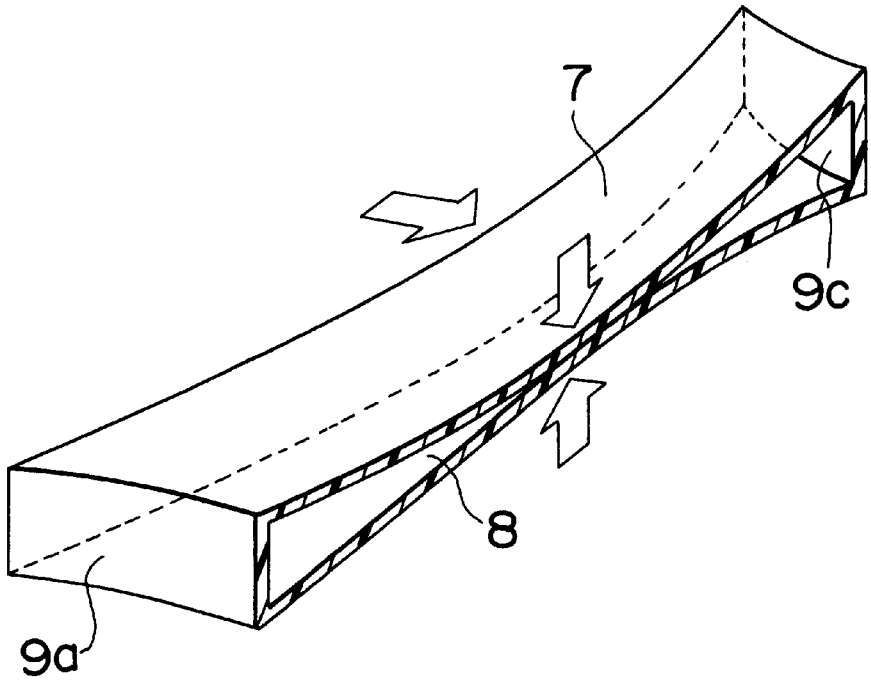
FIG. 5 is a sectional perspective view of the fuel tank taken in a manner similar to that in FIG. 3, wherein the fuel tank is compressed.

Conversely, as shown in FIG. 5, when fuel is discharged from the fuel tank 6 so that the amount of fuel remaining in the fuel tank 6 becomes less than the predetermined amount, the upper and lower walls 7, 8 curve or dent inwards so as to come closer to each other, and the side walls 9*a*–9*d* curve or dent inwards so as to come closer to each other. That is, in the first embodiment, when the amount of fuel in the fuel tank 6 becomes less than the predetermined amount, the upper wall 7 and the lower wall 8 are displaced downwards and upwards, respectively, and the side walls 9*a*–9*d* are displaced horizontally inwards. In this manner, the amount of fuel storable in the fuel tank 6 gradually decreases. Referring back to FIG. 1, a fuel supplying pipe 11 for supplying fuel into the fuel tank 6 is connected at its lower end to a substantially central portion of the lower wall 8 of the fuel tank 6. The upper end of the fuel supplying pipe 11 is provided with a removable cap 12 for closing the fuel supplying pipe 11. When fuel is to be supplied into the fuel tank 6, the cap 12 is removed, so that fuel can be supplied into the fuel tank 6 via the upper end of the fuel supplying pipe 11.

A fuel introducing pipe 14 for introducing fuel from the fuel tank 6 into a fuel pump device 13 is connected at one end thereof to an intermediate portion of the fuel supplying pipe 11. The other end of the fuel introducing pipe 14 is connected to the fuel pump device 13. A fuel pump (not shown) is disposed in the fuel pump device 13. The fuel pump supplies fuel from the fuel pump device 13 to an engine body 16 via a fuel supplying pipe 15.

A pump fuel vapor discharging pipe 17 for discharging fuel vapor from the fuel pump device 13 into an upper portion of the fuel supplying pipe 11 is connected at one end thereof to the fuel pump device 13. The other end of the pump fuel vapor discharging pipe 17 is connected to an upper portion of the fuel supplying pipe 11.

A tank fuel vapor discharging pipe 18 for discharging gas, more particularly, fuel vapor, out of the fuel tank 6 is connected at one end thereof to a substantially central portion of the upper wall 7 of the fuel tank 6, via a float valve 19. The other end of the tank fuel vapor discharging pipe 18 is connected to the fuel pump device 13 so as to open to a space (not shown) defined inside the fuel pump device 13. The tank fuel vapor discharging pipe 18 is flexible so as to follow the displacement of the upper wall 7 of the fuel tank 6.

The float valve 19 has a float 20 that is floatable on liquid fuel. When the surface of liquid fuel in the fuel tank 6 reaches the float valve 19, the float 20 rises to close an opening of the tank fuel vapor discharging pipe 18. Thus, the float valve 19 prevents fuel from leaking out of the fuel tank 6.

The tank fuel vapor discharging pipe 18 is equipped with a check valve 21. The check valve 21 opens when the pressure in a portion of the tank fuel vapor discharging pipe 18 between the check valve 21 and the float valve 19 becomes higher than a predetermined positive pressure level. The check valve 21 closes when the pressure becomes lower than the predetermined positive pressure level. Therefore, once the float valve 19 is closed due to a drop in the surface of liquid fuel level, gas, such as air, fuel vapor or the like, will not enter the fuel tank 6.

A contact plate 22 is mounted to a lower surface of the upper portion 2 of the housing 4 so that when the upper wall 7 of the fuel tank 6 curves upwards, the upper wall 7 contacts the contact plate 22. Also mounted to the lower surface of the upper portion 2 of the housing 4 is a fuel detector device 23 for detecting the amount of fuel stored in the fuel tank 6. The fuel detector device 23 detects the amount of fuel contained in the fuel tank 6 by detecting the displacement of the upper wall 7 of the fuel tank 6.

The air chamber 10 of the fuel tank 6 communicates with the atmosphere via a charcoal canister 24. The charcoal canister 24 contains activated carbon 25. The activated carbon 25 divides the interior space of the charcoal canister 24 into an air chamber-side space 26 and an atmosphere-side space 27. The air chamber-side space 26 directly communicates with the air chamber 10 of the fuel tank 6, and the atmosphere-side space 27 directly communicates with the atmosphere. A canister fuel vapor discharging pipe 28 is connected at one end thereof to the charcoal canister 24 so as to open to the air chamber-side space 26 of the charcoal canister 24. The other end of the canister fuel vapor discharging pipe 28 is connected to a surge tank 33 disposed in an intake passage 30. The canister fuel vapor discharging pipe 28 is provided with a purge control valve 29. The term "purge" herein means introduction of fuel vapor into the intake passage 30 by a negative pressure in the intake passage 30. The purge control valve 29 is controlled to open or close in accordance with engine operating conditions (for example, the intake air flow, the engine revolution speed, or the engine load) when fuel vapor is introduced into the intake passage 30. Furthermore, when a diagnostic operation for the fuel storage device 1 is performed, the opening and closing of the purge control valve 29 is controlled as described below. When the purge control valve 29 is closed, communication between the canister fuel vapor discharging pipe 28 and the intake passage 30 is shut.

A fuel supplying pipe fuel vapor discharging pipe 31 for discharging fuel vapor from the fuel supplying pipe 11 is connected at one end thereof to an upper portion of the fuel supplying pipe 11. The other end of the fuel supplying pipe fuel vapor discharging pipe 31 is connected to a portion of the canister fuel vapor discharging pipe 28 extending between the purge control valve 29 and the charcoal canister 24. The fuel supplying pipe fuel vapor discharging pipe 31 is provided with a diagnostic valve 32. The opening and closing of the diagnostic valve 32 is controlled as described below when the diagnostic operation for the fuel storage device 1 is executed. When the diagnostic valve 32 is closed, communication between the fuel supplying pipe fuel vapor discharging pipe 31 and the canister fuel vapor discharging pipe 28 is shut. The diagnostic valve in the first embodiment corresponds to a shutoff valve for stopping introduction of fuel vapor from the fuel chamber into the intake passage.

A throttle valve 34 is disposed in a portion of the intake passage 30 upstream of the surge tank 33. The opening and closing of the throttle valve 34 is controlled in accordance with the amount of air that needs to be supplied into the engine body 16. Unless the throttle valve 34 is fully open, negative pressure occurs in the surge tank 33. Therefore, when the purge control valve 29 is open, negative pressure is introduced into the charcoal canister 24, so that fuel vapor is introduced from the charcoal canister 24 into the intake passage 30.

An air-fuel ratio sensor 36 for detecting the air-fuel ratio in exhaust gas is mounted to an exhaust passage 35 connected to the engine body 16. In this specification, the terms "upstream" and "downstream" are based on the air flow in the intake passage 30.

The air-fuel ratio sensor 36 is connected to an electronic control unit (ECU) 37. That is, a signal from the air-fuel ratio sensor 36 is inputted to the ECU 37. The purge control valve 29 and the diagnostic valve 32 are also connected to the ECU 37, so that the opening and closing of those valves is controlled by the ECU 37. The fuel storage device 1 according to the first embodiment is equipped with a first alarm device **38*a* and a second alarm device 38*b*. The first alarm device 38*a* and the second alarm device 38*b* are separately connected to the ECU 37, so that the alarm devices are also controlled by the ECU 37**.

The diagnostic operation for the fuel storage device 1 according to the first embodiment will be briefly described. If the fuel storage device 1 is normal, no fuel vapor occurs in the air chamber 10 of the fuel tank 6. Therefore, during execution of purge, the amount of fuel vapor occurring in the fuel supplying pipe 11 and the entire amount of fuel adsorbed in the charcoal canister 24 are introduced into the intake passage 30. After the entire amount of fuel vapor adsorbed in the charcoal canister 24 is released therefrom and introduced into the intake passage 30, only the amount of fuel vapor occurring in the fuel supplying pipe 11 is introduced into the intake passage 30.

During execution of purge, the opening of the purge control valve 29 is increased with increases in the flow of intake air. Therefore, after the entire amount of fuel vapor adsorbed in the charcoal canister 24 is released therefrom and introduced into intake passage 30, the concentration of fuel vapor in intake air (hereinafter, referred to as "purged concentration") becomes proportional to the amount of fuel vapor that occurs in the fuel supplying pipe 11 in a unit time. Therefore, the purged concentration is maintained below a predetermined concentration unless an unexpectedly or abnormally large amount of fuel vapor occurs in the fuel supplying pipe 11. The method for calculating the purged concentration will be described in detail later.

However, if the fuel storage device 1 has a failure due to a hole or permeation of fuel vapor, a fuel component (in the form of fuel vapor and fuel liquid) enters the air chamber from the fuel chamber 5, and dwells in the air chamber 10 in the form of gas or liquid. Thus, fuel vapor occurs in the air chamber 10. As a result, the purged concentration becomes higher than the aforementioned predetermined concentration.

Therefore, in the first embodiment, the diagnostic valve 32 is closed when the purged concentration is equal to or higher than the predetermined concentration. When the diagnostic valve 32 is closed, no fuel vapor is introduced from the fuel supplying pipe 11 into the intake passage 30. Therefore, if there is no hole in any wall of the fuel tank 6 and no vapor fuel in the charcoal canister 24, the purged concentration is expected to decrease to a level at least as low as the predetermined concentration within a predetermined length of time following the closure of the diagnostic valve 32. That is, when the purged concentration decreases to a level at less than or equal to the predetermined concentration within the predetermined length of time following the closure of the diagnostic valve 32, it is diagnosed that no hole has been formed in any wall of the fuel tank 6 and the fuel storage device 1 is normal. Conversely, when the purged concentration does not decrease to a level less than or equal to the predetermined concentration within the predetermined length of time following the closure of the diagnostic valve 32, it is diagnosed that a hole has been formed in a wall of the fuel tank 6 and a large amount of fuel vapor has flown therethrough into the air chamber 10, and that the fuel storage device 1 has a failure. Instead of using the purged concentration, it is also possible to use the amount of fuel vapor as a basis for such a diagnostic operation.

In this manner, the first embodiment is able to diagnose whether the fuel storage device 1 has a failure, that is, a hole formed in a wall of the fuel tank 6. According to the first embodiment, the diagnostic operation can be performed any number of times during a purge. In the first embodiment, it is also possible to diagnose that the fuel storage device has a failure if the length of time needed for the purged concentration to exceed a predetermined concentration after the diagnostic valve is closed during a purge operation is shorter than a predetermined length of time.

The method for calculating the purged concentration, that is, the concentration of fuel vapor in intake air, will be briefly described. In the internal combustion engine according to the first embodiment, the open valve duration of a fuel injection valve for injecting fuel into a cylinder of the engine body 16, that is, the fuel injection duration TAU, is calculated on the basis of the following equation:

$$TAU=TB\cdot FW\cdot(FAF+KG-FPG)$$

In the above equation, TB represents the basic fuel injection time that is needed to control the air-fuel ratio to a target air-fuel ratio, for example, the theoretical air-fuel ratio. The basic fuel injection time TB is prestored as a function of the engine revolution speed and the intake air flow in the ECU 37. KG represents the air-fuel ratio learned correction coefficient (a coefficient based on the air-fuel ratio during a fuel injection time feedback control). FW represents a correction coefficient that combines a warm-up amplifying correction coefficient (a coefficient for increasing the fuel injection amount when the internal combustion engine needs to be warmed up), an acceleration amplifying correction coefficient (a coefficient for increasing the fuel injection amount at the time of acceleration), and the like. FAF represents the feedback correction coefficient for adjusting the actual air-fuel ratio to the theoretical air-fuel ratio on the basis of the output signal from the air-fuel ratio sensor 36. Provided that the target air-fuel ratio is the theoretical air-fuel ratio, the air-fuel ratio sensor 36 produces an output voltage of about 0.9 V if the air-fuel ratio is at the rich side (a state that the fuel concentration in intake air-fuel mixture is higher than the fuel concentration provided at the theoretical air-fuel ratio), and the air-fuel ratio sensor 36 produces an output voltage of about 0.1 V if the air-fuel ratio is at the lean side (a state that the fuel concentration in intake air is lower than that occurring at the theoretical air-fuel ratio). If the air-fuel ratio is at the rich side based on detection by the air-fuel ratio sensor 36, the feedback correction coefficient FAF is decreased by a predetermined value. If the air-fuel ratio is at the lean side, the feedback correction coefficient FAF is increased by a predetermined value. In this manner, the actual air-fuel ratio is adjusted so as to equal the theoretical air-fuel ratio. The feedback correction coefficient FAF is varied around 1.0.

In the above equation, FPG represents the purge correction coefficient expressed as the multiplication product (PGR·FGPG) of the purge rate PGR and the fuel vapor concentration coefficient FGPG indicating the fuel vapor concentration in intake air per unit purge rate. The purge rate PGR is the ratio of the amount of fuel vapor to the amount of intake air, and can be determined on the basis of the engine revolution speed and the open valve proportion of the purge control valve 29.

The fuel vapor concentration coefficient FGPG indicating the fuel vapor concentration in intake air per unit purge rate will be described. If the actual air-fuel ratio becomes a rich-side ratio after a purge operation is started, the feedback correction coefficient FAF is gradually decreased so as to adjust the air-fuel ratio to the theoretical air-fuel ratio. The feedback correction coefficient FAF is decreased with increases in the fuel vapor concentration in intake air. Therefore, the fuel vapor concentration in intake air can be determined on the basis of the amount of reduction of the feedback correction coefficient FAF. A considerable deviation of the feedback correction coefficient FAF from 1.0 is undesirable. Therefore, if the feedback correction coefficient FAF decreases below a threshold after start of a purge operation, the fuel vapor concentration coefficient FGPG is gradually increased from zero and, furthermore, the feedback correction coefficient FAF is increased by an amount corresponding to the amount of increase of the fuel vapor concentration coefficient FGPG. As a result, when the feedback correction coefficient FAF is brought back to 1.0 after the purge operation is started, the fuel vapor concentration coefficient FGPG accurately indicates the fuel vapor concentration in intake air per unit purge rate and, therefore, the purge correction coefficient FPG (=PGR·FGPG) accurately indicates the fuel vapor concentration in intake air. Further detailed description of the method for calculating the fuel vapor concentration in intake air is provided in, for example, U.S. Pat. No. 5,497,757 (issued on Mar. 12, 1996).

The diagnostic operation for the fuel storage device according to the first embodiment will be described with reference to the flowcharts in FIGS. 6 through 8. In step S100 in FIG. 6, it is determined whether a diagnostic execution flag F has been set (F="1"). The diagnostic execution flag F is set once the diagnostic is executed. The diagnostic execution flag F is reset, for example, at every predetermined length of time. However, it is also possible to adopt such an arrangement that the diagnostic execution flag F is reset when the engine is started. If it is determined in step S100 that F="1", which means that the diagnostic operation has been executed once, the operation ends. Conversely, if F="0", which means that the diagnostic operation has not been executed, the operation proceeds to step S102, in order to execute diagnostic.

Figure 6:
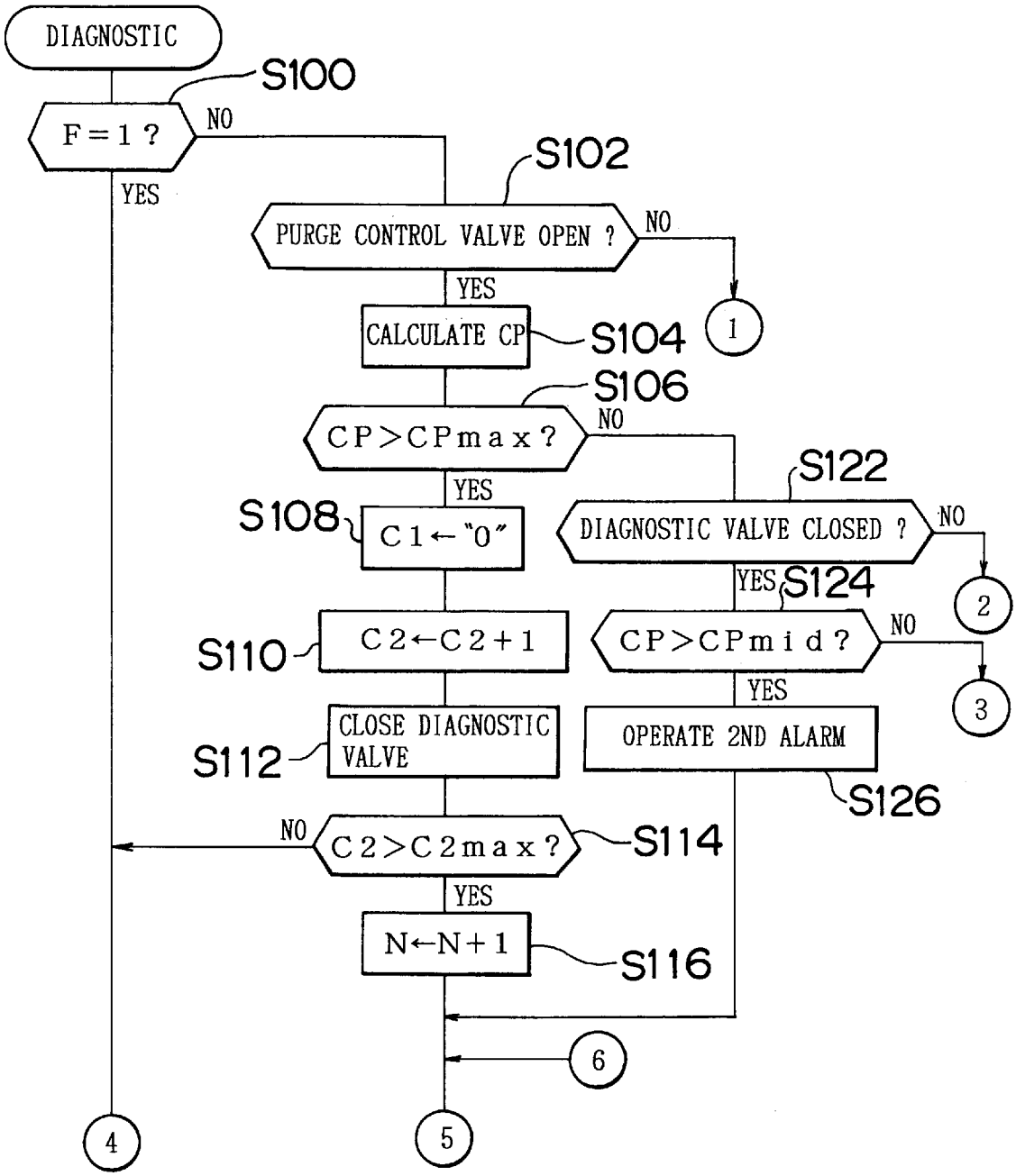
FIG. 6 is a portion of a flowchart illustrating a diagnostic operation for the fuel storage device according to the first embodiment.

In step S102 in FIG. 6, it is determined whether the purge control valve 29 has been open, that is, whether purge is being executed. If the purge control valve 29 is open, it is determined that the diagnostic can be executed because purge is being executed. Therefore, the operation proceeds to step S104, in which the purged concentration CP is calculated. Then the operation proceeds to step S106. Conversely, if the purge control valve 29 is closed, it is determined that purge is not being executed, so that the diagnostic cannot be executed. In order to prepare for the next execution of diagnostic, the operation proceeds to step S152 in FIG. 8, in which a normal counter C1 is cleared (C1←"0"). Subsequently in step S154, a failure counter C2 is cleared (C2←"0"). The operation then ends. The normal counter C1 is incremented by "1" if it is determined during diagnostic that the fuel storage device 1 is normal. The normal counter C1 is cleared if the diagnostic cannot be executed as mentioned above or if during diagnostic, it is diagnosed that there is a possibility of a failure of the fuel storage device 1. The failure counter C2 is incremented by "1" if during diagnostic, it is diagnosed that the fuel storage device 1 has a failure. The failure counter C2 is cleared if the diagnostic cannot be executed as mentioned above or if during diagnostic, it is diagnosed that there is a possibility that the fuel storage device 1 is normal.

In step S106 in FIG. 6, it is determined whether the purged concentration CP is greater than a maximum purged concentration CPmax (CP>CPmax). If CP>CPmax, it is determined that there is a possibility that a hole has been formed in a wall of the fuel tank 6 and, therefore, a fault has occurred in the fuel storage device 1. Then the operation proceeds to step S108, in which the normal counter C1 is cleared (C1←"0"). Subsequently in step S110, the failure counter C2 is incremented by "1" (C2←C2+1). After the diagnostic valve 32 is closed in step S112, the operation proceeds to step S114. Conversely, if CP≦CPmax instep S106, it is determined that no hole has been formed in any wall of the fuel tank 6, and the operation proceeds to step S122.

In step S114 in FIG. 6, it is determined whether the value of the failure counter C2 is greater than a predetermined maximum value C2max (C2>C2max). If C2>C2max, which means that since it was determined in step S106 that the purged concentration was higher than the maximum purged concentration, the purged concentration has not decreased below the maximum purged concentration although the value of the failure counter C2 has become greater than the predetermined maximum value, then it is determined that the fuel storage device 1 has a failure. The operation then proceeds to step S116, in which the number N of times of executing the diagnostic is incremented by "1" (N←N+1). The operation then proceeds to step S139 in FIG. 8, in which the diagnostic valve 32 is opened. Subsequently in step S140, the normal counter C1 is cleared (C1←"0"). In step S142, the failure counter C2 is cleared (C2←"0"). After the diagnostic execution flag F is set (F←"1") in step S144, the operation proceeds to step S146. The number N of times of executing the diagnostic is cleared when it is notified that the fuel storage device 1 has a failure. Conversely, if it is determined in step S114 that C2≦C2max, it is presently impossible to determine whether the fuel storage device 1 has a failure. Then the operation ends.

Figure 8:
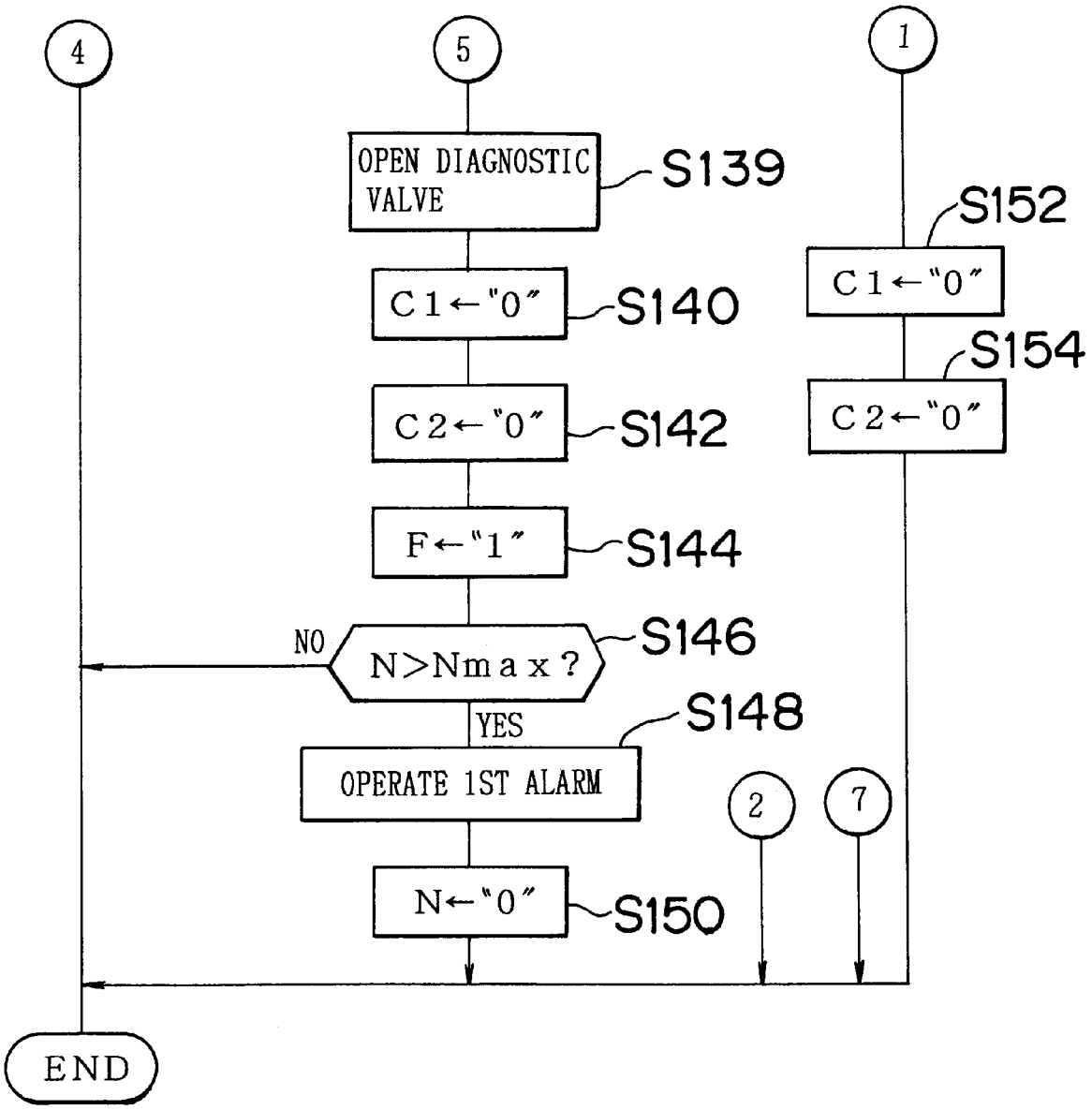
FIG. 8 is the remaining portion of the flowchart illustrating the diagnostic operation for the fuel storage device according to the first embodiment.

In step S146 in FIG. 8, it is determined whether the number N of times of executing the diagnostic is greater than a maximum number Nmax (N>Nmax). If N>Nmax, which means that a failure of the fuel storage device 1 has been determined more than the maximum number Nmax of times, then the operation proceeds to step S148. In step S148, the first alarm device 38*a* is operated to notify that the fuel storage device 1 has a failure. Subsequently in step S150, the number N of times of executing the diagnostic is cleared (N←"0"). Then the operation ends. Conversely, if it is determined in step S146 that N≦Nmax, it is presently inappropriate to determine that the fuel storage device 1 has a failure. Therefore, the operation ends.

In step S122 in FIG. 6, it is determined whether the diagnostic valve 32 has been closed. If the diagnostic valve 32 is closed, it is determined that the diagnostic is being executed. In order to continue the diagnostic, the operation proceeds to step S124. Conversely, if the diagnostic valve 32 is open, it is determined that the diagnostic is not being executed although purge is being executed. Then the operation ends.

In step S124 in FIG. 6, it is determined whether the purged concentration CP is greater than an intermediate purged concentration CPmid (CP>CPmid), where the intermediate purged concentration CPmid is less than the maximum purged concentration CPmax. If CP>CPmid, it is determined that no hole has been formed in any wall of the fuel tank 6 but fuel vapor has penetrated a wall of the fuel tank 6 because the purged concentration CP is higher than the intermediate purged concentration CPmid although the purged concentration CP has become lower than the maximum purged concentration CPmax before the value of the failure counter C2 reaches the predetermined maximum value. The operation then proceeds to step S126, in which the second alarm device 38*b* is operated to notify that fuel vapor has permeated through a wall of the fuel tank 6 and therefore has been let out of the fuel chamber 5. The operation then proceeds to step S139 in FIG. 8. The steps that follow are described above, and will not be described again. If the operation proceeds to step S146 after the second alarm device 38*b* has been operated, the number N of times of executing the diagnostic has not been incremented, so that, in step S146, it is determined that N≦Nmax. The operation then ends. Conversely, if CP≦CPmid in step S124, it is determined that there is a possibility that the fuel storage device 1 is normal, because CP≦CPmid in step S124 means that the purged concentration CP has decreased to or below the intermediate purged concentration CPmid before the value of the failure counter C2 reaches the predetermined maximum value. The operation then proceeds to step S128 in FIG. 7, in which the failure counter C2 is cleared (C2←"0"). After the normal counter C1 is incremented by "1" (C1←C1+1) in step S130, the operation proceeds to step S132.

Figure 7:
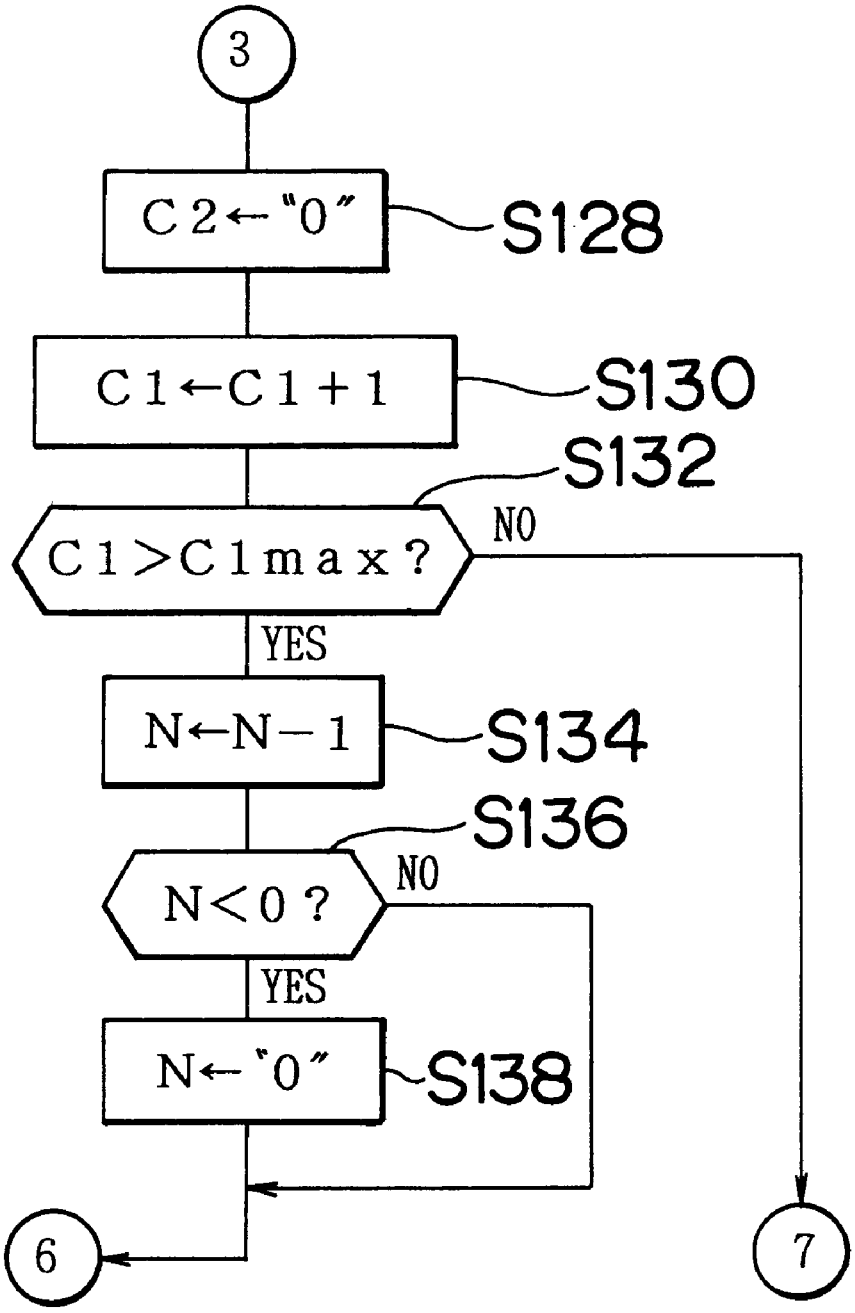
FIG. 7 is another portion of the flowchart illustrating the diagnostic operation for the fuel storage device according to the first embodiment.

In step S132 in FIG. 7, it is determined whether the value of the normal counter C1 is greater than a predetermined maximum value C1max (C1>C1max). If C1>C1max, it is determined that the fuel storage device 1 is normal because the value of the normal counter C1 is now greater than the predetermined maximum value C1max after it was determined that the purged concentration CP was decreased to or below the maximum purged concentration CPmax following the determination in step S106 that the purged concentration CP was greater than the maximum purged concentration CPmax. The operation proceeds to step S134, in which the number N of times of executing the diagnostic is decremented by "1" (N←N−1). Subsequently in step S136, it is determined whether the number N of times of executing the diagnostic is less than zero (N<0). If N<0, the number N of times of executing the diagnostic is set to zero (N<0) in step S138. The operation then proceeds to step S139 in FIG. 8. The steps that follow have been described above, and will not be described again. Conversely, if it is determined in step S132 that C1≦C1max, it is presently impossible to determine whether the fuel storage device 1 is normal. Therefore, the operation ends.

According to the first embodiment, if the number of times that it has been diagnosed that the fuel storage device 1 has a failure is greater by a predetermined value than the number of times that it has been diagnosed that the fuel storage device 1 is normal, then it is warned that the fuel storage device 1 has a failure. Therefore, the first embodiment excludes a false diagnostic regarding the fuel storage device 1 caused by a temporary increase in the purged concentration. Furthermore, the first embodiment makes it possible to warn that fuel vapor has permeated through a wall of the fuel tank 6.

Furthermore, in the first embodiment, the timing of diagnosing a fault in the partition wall may be set to a timing during a period when the internal combustion engine operating condition is stable (that is, when changes in the intake air flow, the engine load and the engine revolution speed are small), or a timing at which the learning of the purged concentration of fuel vapor introduced from the fuel supplying pipe into the intake passage is completed (that is, when the purged concentration CP has been learned and the present purged concentration is determined). Such a modification improves the diagnostic accuracy.

Through utilization of the invention, it is possible to perform diagnostics regarding not only the partition wall, but also the fuel chamber, the charcoal canister, a hole failure or a clogging failure of the fuel supplying pipe fuel vapor discharging pipe, an opening or closing failure of the purge control valve, and the like.

A fuel storage device according to a second embodiment of the invention will be described. The amount of fuel vapor that permeates through a wall of the fuel tank is very small. Therefore, although fuel vapor has actually permeated through a wall of the fuel tank, the closure of the purge control valve during a purge in accordance with the first embodiment may not cause a sufficient reduction in the purged concentration. Thus, there is a possibility that it may be difficult to diagnose that fuel vapor is permeating through a wall of the fuel tank in accordance with the first embodiment. The second embodiment is designed to more reliably diagnose whether fuel vapor is permeating through a wall of the fuel tank.

Figure 9:
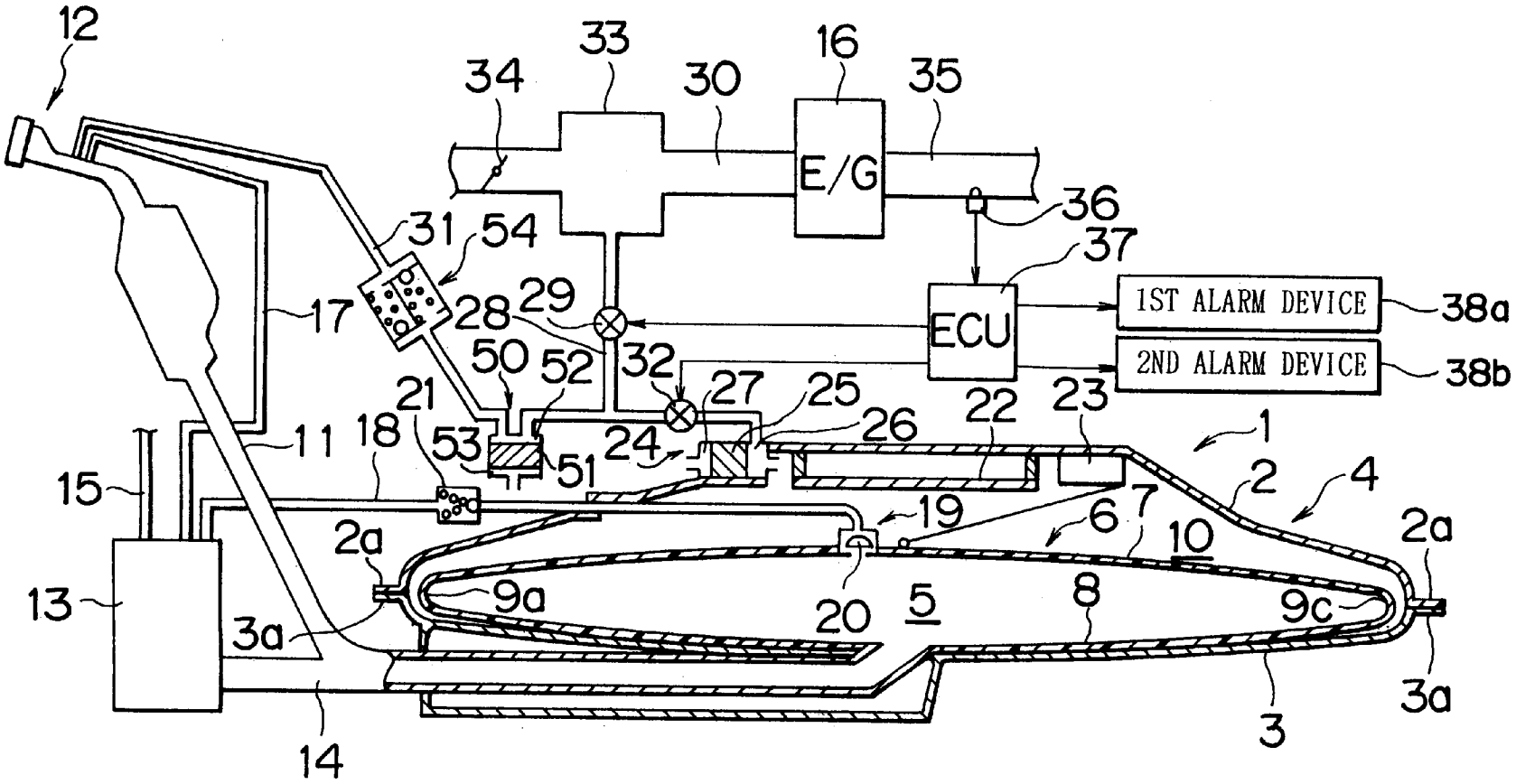
FIG. 9 illustrates a fuel storage device according to a second embodiment of the invention.

As shown in FIG. 9, in a fuel storage device 1 according to the second embodiment, a diagnostic valve 32 is disposed in a portion of a canister fuel vapor discharging pipe 28 extending between a purge control valve 29 and a charcoal canister 24. Therefore, the diagnostic valve 32 according to the second embodiment corresponds to a shutoff valve for stopping introduction of fuel vapor from an air chamber 10 of a fuel tank 6 into an intake passage 30. The diagnostic valve 32 remains closed, except when a diagnostic operation for the fuel storage device 1 is executed.

A main charcoal canister 50 for temporarily adsorbing fuel vapor from a fuel supplying pipe 11 and retaining fuel vapor if there is any fuel vapor in the fuel supplying pipe 11 is connected to a fuel supplying pipe fuel vapor discharging pipe 31. The main charcoal canister 50 contains activated carbon 51. The activated carbon 51 divides the interior space of the main charcoal canister 50 into a discharging pipe-side space 52 and an atmosphere-side space 53. The discharging pipe-side space 52 directly communicates with the fuel supplying pipe fuel vapor discharging pipe 31, and the atmosphere-side space 53 directly communicates with the atmosphere.

A tank pressure control valve 54 for adjusting the pressure in the fuel tank 6 is disposed in a portion of the fuel supplying pipe fuel vapor discharging pipe 31 between the fuel supplying pipe 11 and the main charcoal canister 50 (hereinafter, the portion of the fuel supplying pipe fuel vapor discharging pipe 31 will be referred to as "fuel supplying pipe-side discharging pipe"). The tank pressure control valve 54 is opened to release pressure from the fuel supplying pipe-side discharging pipe 31 if the pressure in the fuel supplying pipe-side discharging pipe 31 becomes higher, by a first predetermined pressure value, than the pressure in a portion of the fuel supplying pipe fuel vapor discharging pipe 31 between the main charcoal canister 50 and the canister fuel vapor discharging pipe 28 (hereinafter, the portion of the fuel supplying pipe fuel vapor discharging pipe 31 will be referred to as "discharging pipe-side discharging pipe"). The tank pressure control valve 54 is opened to release pressure from the discharging pipe-side discharging pipe 31 if the pressure in the discharging pipe-side discharging pipe 31 becomes higher than the pressure in the fuel supplying pipe-side discharging pipe 31 by a second predetermined pressure value. Other constructions are substantially the same as in the first embodiment, and will not be described again.

A diagnostic operation for the fuel storage device 1 according to the second embodiment will be briefly described. In the second embodiment, in order to execute the diagnostic operation, the diagnostic valve 32 is opened when the fuel vapor concentration in intake air becomes constant because vapor fuel adsorbed by the main charcoal canister 50 has been released therefrom and introduced into intake air by a purge executed after the diagnostic valve 32 has been closed for a predetermined length of time.

If no hole has been formed in any wall of the fuel tank 6 and no fuel vapor has been allowed to permeate through a wall of the fuel tank 6, there is no fuel vapor present in the air chamber 10 or the charcoal canister 24. Therefore, it is diagnosed that no hole has been formed in any wall of the fuel tank 6 and no fuel vapor has permeated through any wall of the fuel tank 6 and, therefore, that the fuel storage device 1 is normal, if the purged concentration remains below a predetermined concentration or the change in the purged concentration remains less than a predetermined value after the diagnostic valve 32 has been open.

Conversely, if the purged concentration is higher than the predetermined concentration at the elapse of more than a predetermined length of time after the diagnostic valve 32 has been opened, it is diagnosed that a relatively large amount of fuel vapor is occurring in the air chamber 10 per unit time and, therefore, that a hole has been formed in a wall of the fuel tank 6, that is, it is diagnosed that the fuel storage device 1 has a failure due to a hole formed in a wall of the fuel tank 6.

In contrast, the amount of fuel vapor that can permeate through a wall of the fuel tank 6 into the air chamber 10 per unit time is relatively small (in comparison with the amount of fuel that would pass through a hole formed in a wall of the fuel tank 6). In the second embodiment, however, because the diagnostic valve 32 remains closed for the predetermined length of time, a relatively great amount of fuel vapor will be adsorbed by the charcoal canister 24 if fuel vapor is allowed to permeate a wall of the fuel tank 6. Therefore, when the diagnostic valve 32 is opened, the amount of fuel vapor adsorbed by the charcoal canister 24 will be released therefrom and introduced into the intake passage 30. Hence, in the second embodiment, if after the diagnostic valve 32 is opened the purged concentration temporarily increases above the predetermined purged concentration and then decreases below the predetermined purged concentration at the elapse of more than the predetermined length of time, it is diagnosed that fuel vapor is present in the air chamber 10 but in a relatively small amount and, therefore, the fuel storage device 1 has a failure due to permeation of fuel through a wall of the fuel tank 6, not due to passage of fuel through a hole formed in a wall of the fuel tank 6. In this manner, the second embodiment is able to reliably diagnose whether fuel vapor is permeating through any wall of the fuel tank 6.

A fuel storage device according to a third embodiment of the invention will be described. If there is a hole formed in any wall of the fuel tank 6 in the first embodiment, fuel leaks through the hole and dwells in a lowermost portion of the fuel storage device 1. Therefore, fuel vapor would occur more in a lower portion of the fuel storage device 1 than in an upper portion thereof. In the first embodiment, the diagnostic operation is performed if the purged concentration becomes equal to or higher than the predetermined concentration. Consequently, if fuel vapor is collected from an upper portion of the fuel storage device 1 to introduce fuel vapor into the intake passage 30, there may be a case where even though a hole has been formed in a wall of the fuel tank 6, the purged concentration does not rise to or above the predetermined concentration. Thus, the first embodiment may fail to diagnose a failure of the fuel storage device 1. The third embodiment is designed to reliably diagnose a failure of the fuel storage device.

Figure 10:
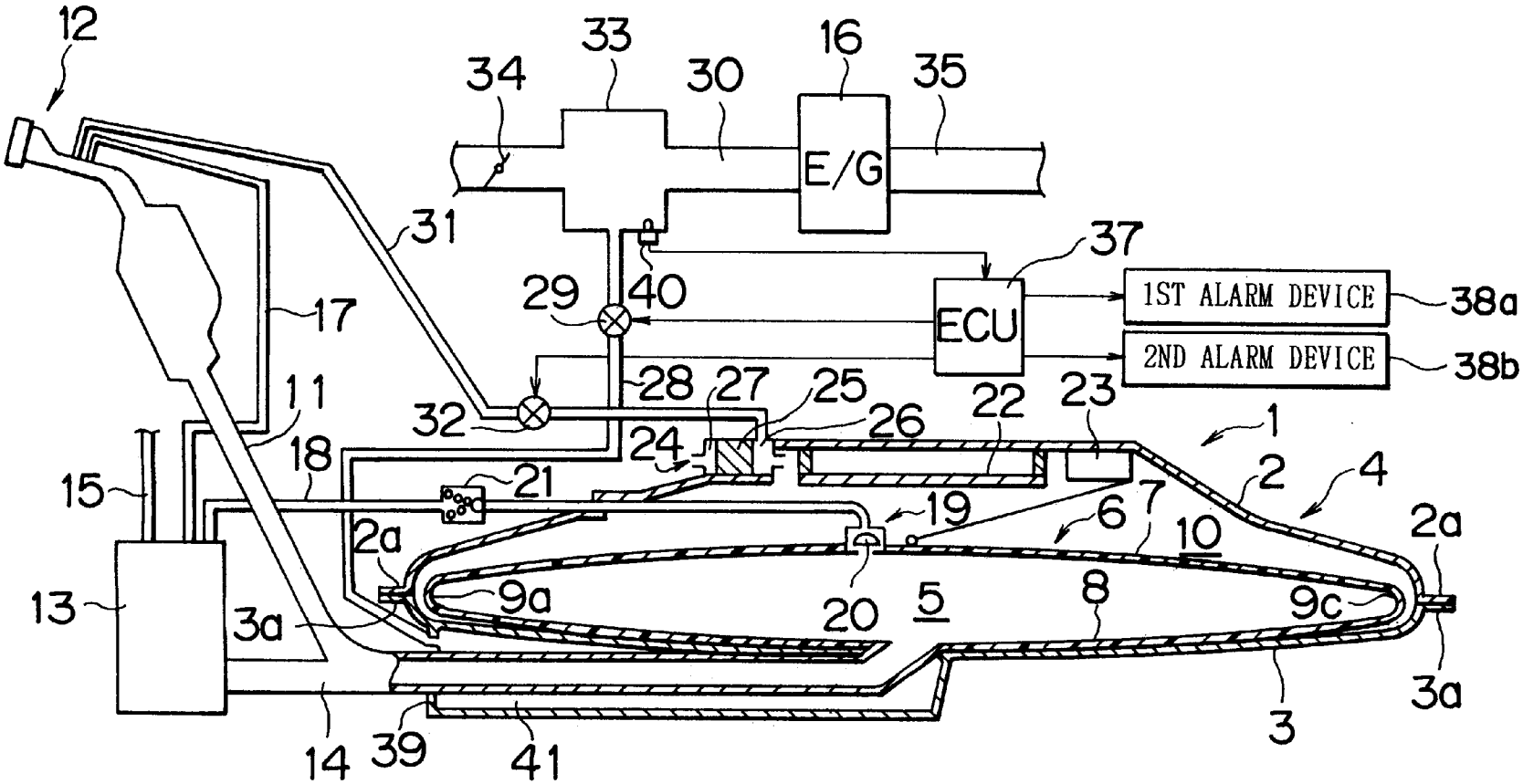
FIG. 10 illustrates a fuel storage device according to a third embodiment of the invention.

Referring to FIG. 10, a fuel supplying pipe fuel vapor discharging pipe 31 is connected at one end thereof to a charcoal canister 24 in such a manner that the fuel supplying pipe fuel vapor discharging pipe 31 is opened to an air chamber-side space 26 of the charcoal canister 24. A canister fuel vapor discharging pipe 28 is connected at one end thereof to a bottom wall portion 39 of a housing 4 of a fuel storage device 1 in such a manner that the canister fuel vapor discharging pipe 28 is opened to a lower space 41 in the fuel storage device 1. Instead of the air-fuel ratio sensor 36 in the first embodiment, a fuel vapor concentration sensor (HC sensor) 40 for directly detecting the amount of a fuel component in an intake passage 30 is mounted to a surge tank 33 provided in the intake passage 30. The fuel vapor concentration sensor 40 is connected to an electronic control unit (ECU) 37. Other constructions and operations thereof are substantially the same as those in the first embodiment, and will not be described again.

The fuel vapor concentration sensor 40 may be replaced by an oxygen concentration sensor for detecting the oxygen concentration in intake air. In such a case, determination is made in such a manner that as the oxygen concentration in intake air becomes lower, the fuel vapor concentration in intake air becomes higher.

In the third embodiment, fuel vapor is collected from the lower space 41 of the fuel storage device 1 in order to introduce fuel vapor into the intake passage 30. If a hole has been formed in any wall of the fuel tank 6, fuel leaking out through the hole dwells in a lowermost portion of the fuel storage device 1, so that fuel vapor is present in a larger amount in the lower space 41 of the fuel storage device 1 than in an upper space of the fuel storage device 1. Therefore, the third embodiment is able to more reliably diagnose whether the fuel storage device 1 has a failure than the first embodiment.

Next described will be a fuel storage device according to a fourth embodiment of the invention. The fourth embodiment makes it possible to perform diagnostic on a fuel storage device that has a simpler construction than the fuel storage device in the first embodiment.

Figure 11:
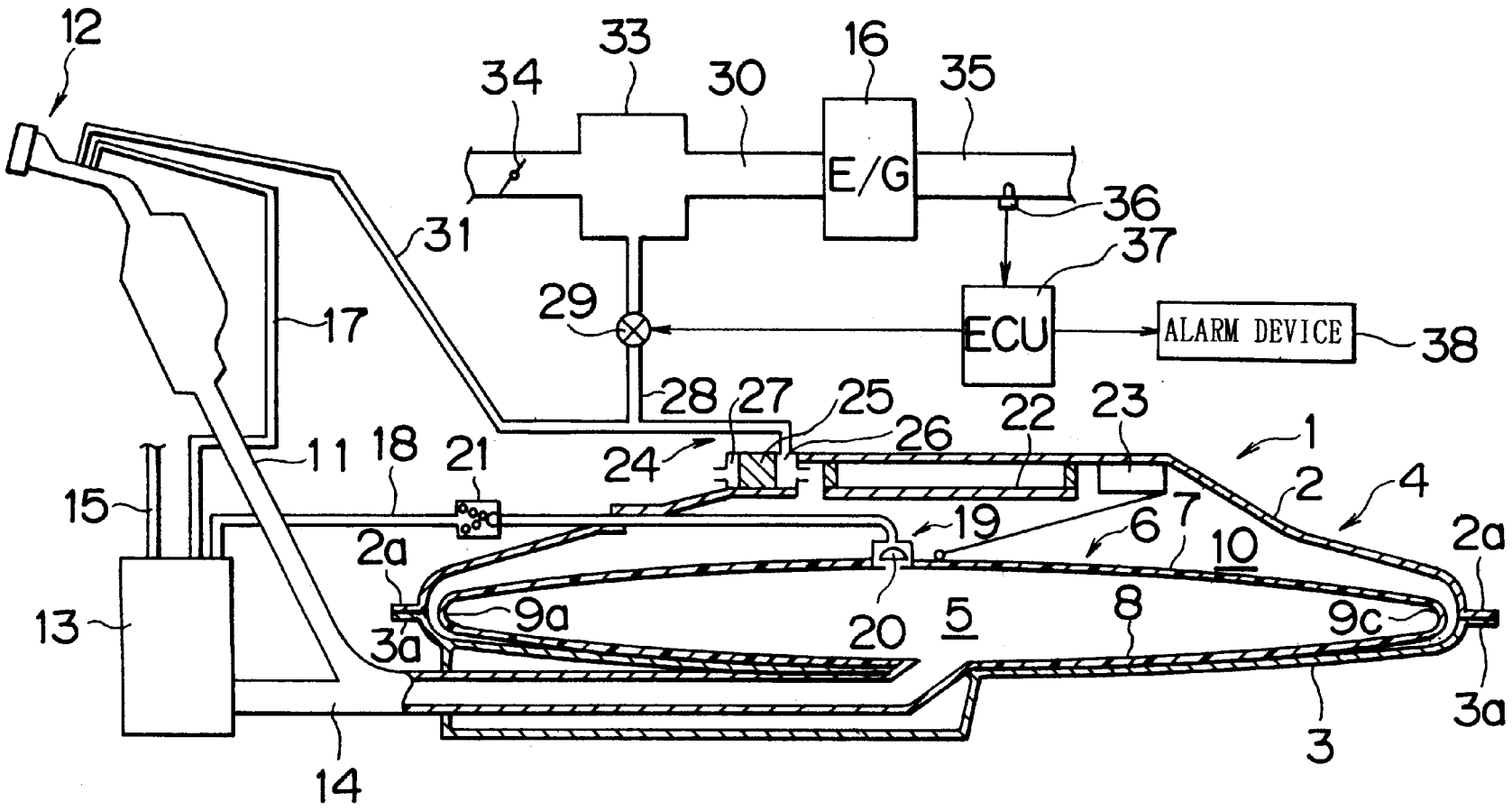
FIG. 11 illustrates a fuel storage device according to a fourth embodiment of the invention.

As shown in FIG. 11, the fourth embodiment omits the diagnostic valve 32 provided in the first embodiment. A fuel storage device in the fourth embodiment has an alarm device 38 in replace of the first alarm device 38*a* and the second alarm device 38*b*. Other constructions are substantially the same as in the first embodiment, and will not be described again.

A diagnostic operation for the fuel storage device according to the fourth embodiment will be briefly described. In the fourth embodiment, it is diagnosed that a hole has been formed in a wall of the fuel tank 6 and, therefore, the fuel storage device 1 has a failure, if the number of times that the purged concentration has exceeded a predetermined concentration reaches or exceeds a predetermined number. In this manner, the fourth embodiment is able to execute diagnostic on the fuel storage device having a simplified construction.

Figure 12:
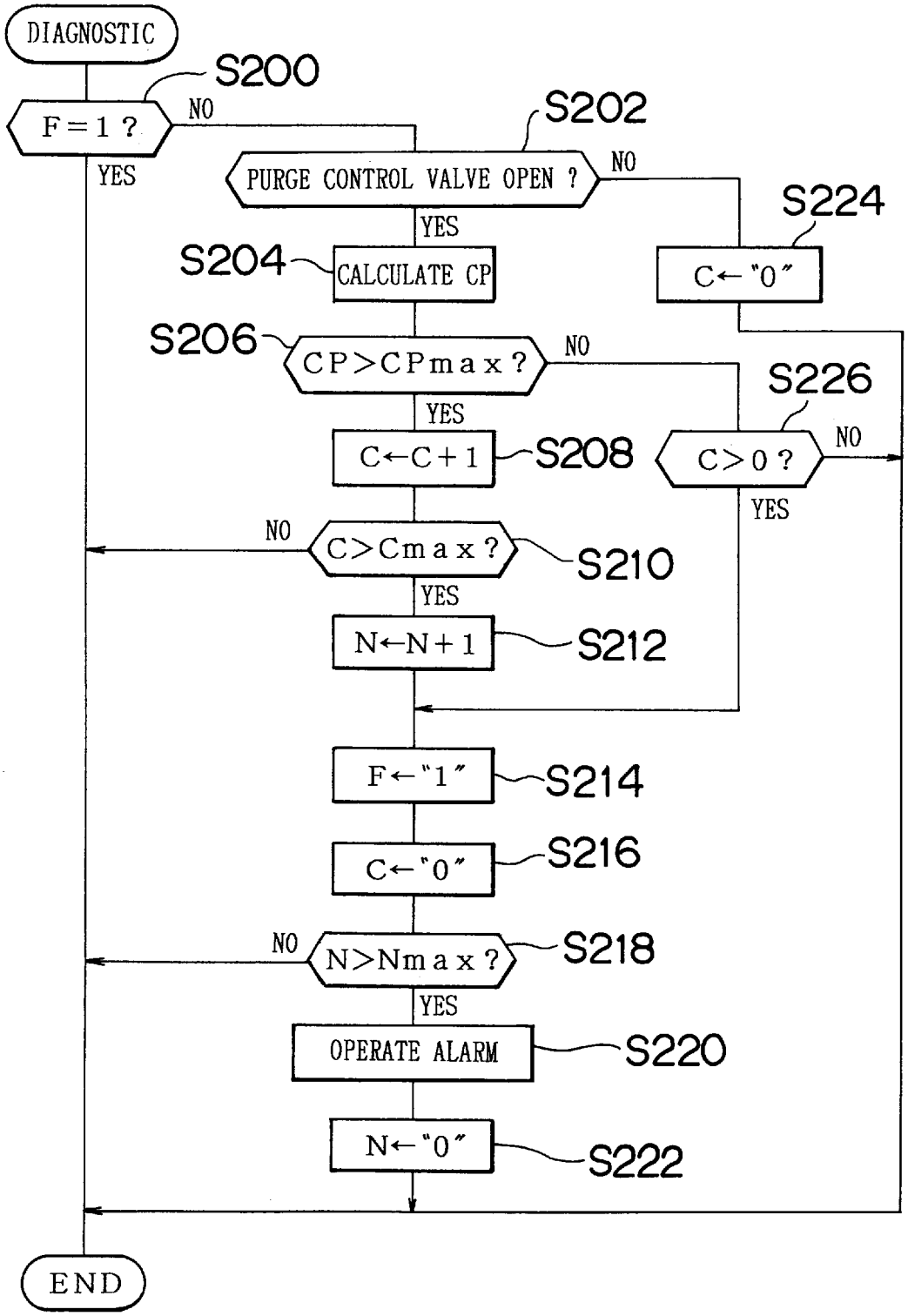
FIG. 12 is a flowchart illustrating a diagnostic operation for the fuel storage device according to the fourth embodiment.

A diagnostic operation for the fuel storage device according to the fourth embodiment will be described in detail with reference to the flowchart in FIG. 12. In step S200, it is determined whether a diagnostic execution flag F has been set (F="1"). The diagnostic execution flag F in the fourth embodiment is substantially the same as the diagnostic execution flag F in the first embodiment. If it is determined in step S200 that F="1", the operation ends because F="1" means that the diagnostic operation has been executed once. Conversely, if F="0", which means that the diagnostic operation has not been executed, the operation proceeds to step S202, in order to execute diagnostic.

In step S202, it is determined whether the purge control valve 29 has been open, that is, whether purge is being executed. If the purge control valve 29 is open, it is determined that the diagnostic can be executed because purge is being executed. Therefore, the operation proceeds to step S204, in which the purged concentration CP is calculated. Then the operation proceeds to step S206. The purged concentration can be calculated by the same method as in the first embodiment. Conversely, if the purge control valve 29 is closed, it is determined that purge is not being executed, so that the diagnostic cannot be executed. In order to prepare for the next execution of diagnostic, the operation proceeds to step S224, in which a failure counter C is cleared (C←0"). The failure counter C is incremented by "1"if during diagnostic, it is diagnosed that the fuel storage device 1 has a failure. The failure counter C is cleared if the diagnostic cannot be executed as mentioned above or if it is diagnosed that there is a possibility that the fuel storage device 1 has a failure.

In step S206, it is determined whether the purged concentration CP is higher than a maximum purged concentration CPmax (CP>CPmax). If CP>CPmax, it is determined that there is a possibility that a hole has been formed in a wall of the fuel tank 6 and, therefore, the fuel storage device 1 has a failure. Subsequently in step S208, the failure counter C is incremented by "1" (C←C+1). The operation then proceeds to step S210. Conversely, if CP≦CPmax, it is determined that no hole has been formed in any wall of the fuel tank 6, and the operation proceeds to step S226.

In step S226, it is determined whether the value of the failure counter C is greater than zero (C>0). If C>0, it is determined that the purged concentration CP is now lower than the maximum purged concentration CPmax after exceeding the maximum purged concentration CPmax once, so that the diagnostic operation needs to be ended. Subsequently in step S214, the diagnostic execution flag F is set (F←"1). After the failure counter C is cleared (C←"0) in step S216, the operation proceeds to step S218.

In step S210, it is determined whether the value of the failure counter C is greater than a predetermined maximum value Cmax (C>Cmax). If C>Cmax, it is determined that the fuel storage device 1 has a failure because C>Cmax in step 210 means that the purged concentration CP has remained at or above the maximum purged concentration CPmax even though the failure counter C has been incremented beyond the predetermined maximum value Cmax after it was determined in step S206 that the purged concentration CP was higher than the maximum purged concentration CPmax. The operation then proceeds to step S212, in which the number N of times of executing diagnostic is incremented by "1" (N←N+1). Subsequently in step S214, the diagnostic execution flag F is set (F←"1") . After the failure counter C is cleared (C←"0") instep S216, the operation proceeds to step S218. The number N of times of executing diagnostic is the same as in the first embodiment. Conversely, if it is determined in step S210 that C≦Cmax, the operation ends because it is presently impossible to determine whether the fuel storage device 1 has a failure.

In step S218, it is determined whether the number N of times of executing diagnostic is greater than a maximum number Nmax (N>Nmax). If N>Nmax, it is considered that it has been determined that the fuel storage device 1 has a failure, more than the maximum number Nmax of times. The operation then proceeds to step S220, in which the alarm device 38 is operated to notify that the fuel storage device 1 has a failure. Subsequently in step S222, the number N of times of executing diagnostic is cleared (N←"0"). The operation then ends. Conversely, if it is determined in step S218 that N≦Nmax, it is presently inappropriate to determine that the fuel storage device 1 has a failure. Therefore, the operation ends.

In the fourth embodiment, therefore, the purge control valve 29 corresponds to a shutoff valve for stopping introduction of fuel vapor from the air chamber 10 into the intake passage 30.

Next described will be a diagnostic operation for a fuel storage device according to a fifth embodiment of the invention. The fuel storage device in the fifth embodiment is substantially the same as that in the first embodiment, and will not be described below. The first embodiment diagnoses whether the fuel storage device has a failure by comparing the purged concentration with the predetermined concentration, whereas the fifth embodiment diagnoses whether the fuel storage device has a failure on the basis of the amount of change in the purged concentration occurring around the time at which a diagnostic valve is opened.

The diagnostic operation for the fuel storage device according to the fifth embodiment will be described in detail with reference to FIGS. 13 and 14. In step S300, it is determined whether a diagnostic execution flag F has been set (F="1"). The diagnostic execution flag F in the fifth embodiment is substantially the same as the diagnostic execution flag F in the first embodiment. If it is determined in step S300 that F="1", the operation ends because F="1" means that the diagnostic operation has been executed once. Conversely, if F="0", which means that the diagnostic operation has not been executed, the operation proceeds to step S302, in order to execute diagnostic.

Figure 13:
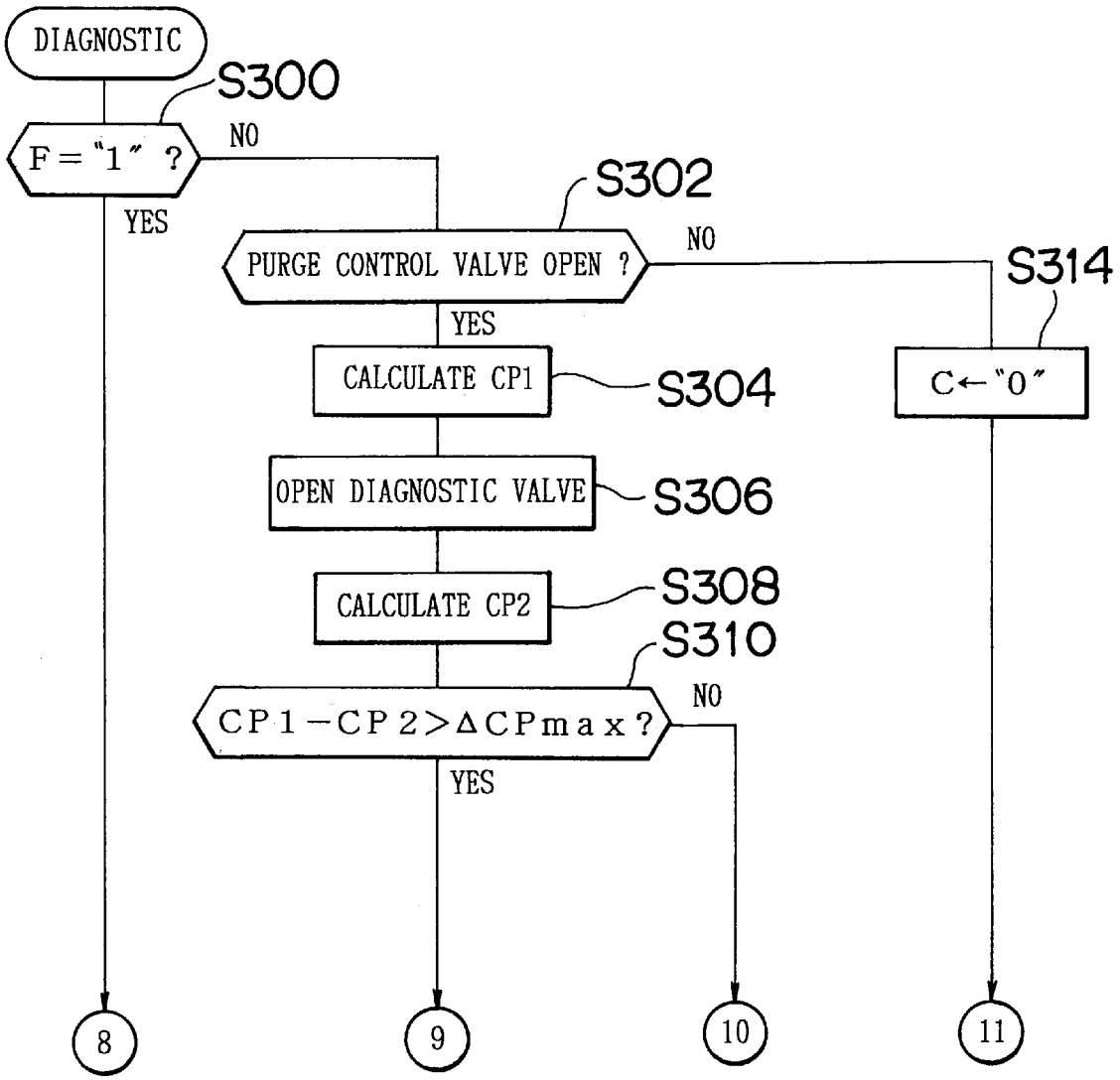
FIG. 13 is a portion of a flowchart illustrating a diagnostic operation for a fuel storage device according to a fifth embodiment of the invention.

In step s302 in FIG. 13, it is determined whether the purge control valve 29 has been open, that is, whether purge is being executed. If the purge control valve 29 is open, it is determined that the diagnostic can be executed because purge is being executed. Therefore, the operation proceeds to step S304, in which the purged concentration CP1 before the diagnostic valve 32 is closed is calculated. Subsequently in step S306, the diagnostic valve 32 is closed. After the purged concentration CP2 after the diagnostic valve 32 has been closed is calculated in step S308, the operation proceeds to step S310. Conversely, if it is determined in step S302 that the purge control valve 29 has been closed, it is considered that purge is not being executed, so that the diagnostic cannot be executed. In order to prepare for the next execution of diagnostic, the operation proceeds to step S314, in which a failure counter C is cleared (C←"0"). The operation then ends. The failure counter C in this embodiment is substantially the same as that used in the first embodiment.

In step S310 in FIG. 13, it is determined whether the difference between the purged concentration CP1 before the diagnostic valve 32 is closed and the purged concentration CP2 after the diagnostic valve 32 is closed is greater than a maximum purged concentration difference ΔCPmax (CP1−CP2 >ΔCPmax). If CP1−CP2>ΔCPmax, it is determined that a hole has been formed in a wall of the fuel tank 6 and, therefore, the fuel storage device 1 has a failure. The operation then proceeds to step S316 in FIG. 14, in which the number N of times of executing diagnostic is incremented by "1" (N←N+1). Subsequently in step S320, the diagnostic valve 32 is opened. After in step S322 a failure counter C is cleared (C←"0"), the diagnostic execution flag F is set (F←"1") in step S324. The operation then proceeds to step S326. The number N of times of executing diagnostic is substantially the same as in the first embodiment. Conversely, if CP1−CP2 ≦ΔCPmax in step S310, it is determined that no hole has been formed in any wall of the fuel tank 6. The operation then proceeds to step S332 in FIG. 14.

Figure 14:
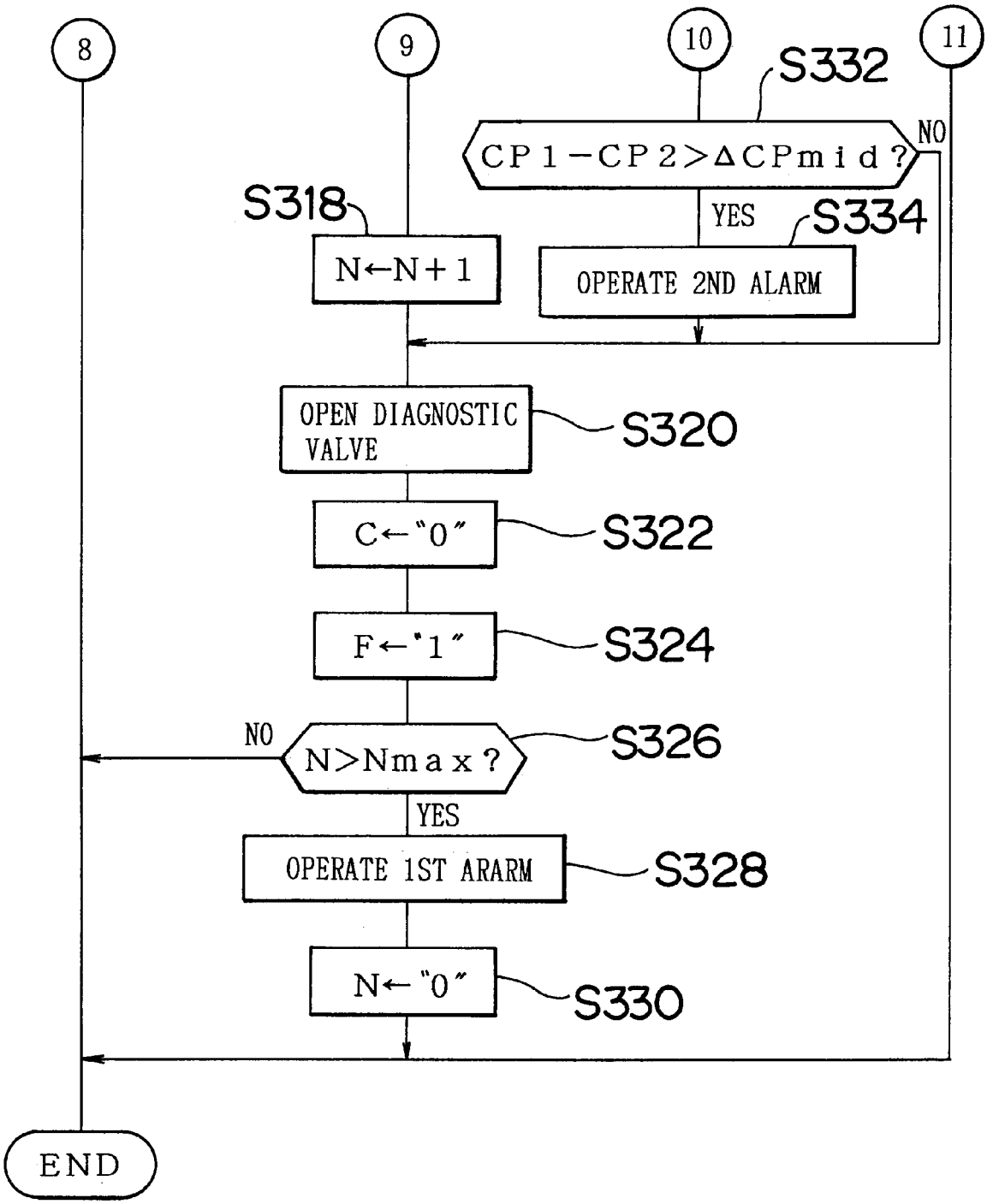
FIG. 14 is the remaining portion of the flowchart illustrating the diagnostic operation for the fuel storage device according to the fifth embodiment.

In step S326 in FIG. 14, it is determined whether the number N of times of executing diagnostic is greater than a maximum number Nmax (N>Nmax). If N>Nmax, it is considered that it has been determined that the fuel storage device 1 has a failure, more than the maximum number Nmax of times. Then, the operation proceeds to step S328, in which the first alarm device 38*a* is operated to notify that the fuel storage device 1 has a failure. Subsequently in step S330, the number N of times of executing diagnostic is cleared (N←"0"). The operation then ends. Conversely, if N≦Nmax in step S326, it is presently inappropriate to determine that the fuel storage device 1 has a failure. Therefore, the operation ends.

In step S332 in FIG. 14, it is determined whether the difference between the purged concentration CP1 before the diagnostic valve 32 is closed and the purged concentration CP2 after the diagnostic valve 32 is closed is greater than an intermediate purged concentration difference ΔCPmid (CP1−CP2>ΔCPmid), where the intermediate purged concentration difference ΔCPmid is smaller than the maximum purged concentration difference ΔCPmax. If CP1−CP2>ΔCPmid in step S332, it is determined that fuel vapor has permeated through a wall of the fuel tank 6. The operation then proceeds to step S334, in which the second alarm device 38*b* is operated to notify that fuel vapor has permeated through a wall of the fuel tank 6. The operation then proceeds to step S320. The steps that follow have been described above, and will not be described again. If the operation proceeds to step S326 after the second alarm device 38*b* has been operated, the number N of times of executing diagnostic has not been incremented, so that it is always determined in step S326 that N≦Nmax. Then the operation ends. Conversely, if CP1−CP2 ≦ΔCPmid in step S332, it is determined that no fuel vapor has permeated through any wall of the fuel tank 6, and the operation proceeds to step S320. The steps that follow have been described above, and will not be described again. If the operation proceeds to step S326 via step S332, the number N of times of executing diagnostic has not been incremented, so that it is determined in step S326 that N≦Nmax. Then the operation ends.

Next described will be a fuel storage device according to a sixth embodiment of the invention. If the diagnostic of the fuel storage device 1 in the second embodiment is performed, fuel vapor from the fuel supplying pipe 11 and gas from the air chamber 10 are simultaneously introduced into the intake passage 30. In the second embodiment, therefore, the purged concentration may become high even if there is no fuel vapor in the air chamber 10, for example, in a case where a relatively large amount of fuel vapor temporarily occurs in the fuel supplying pipe 11. Hence, there is the danger of falsely diagnosing that the fuel storage device 1 has a failure. The sixth embodiment excludes the danger of falsely diagnosing that the fuel storage device 1 has a failure as described above.

Figure 15:
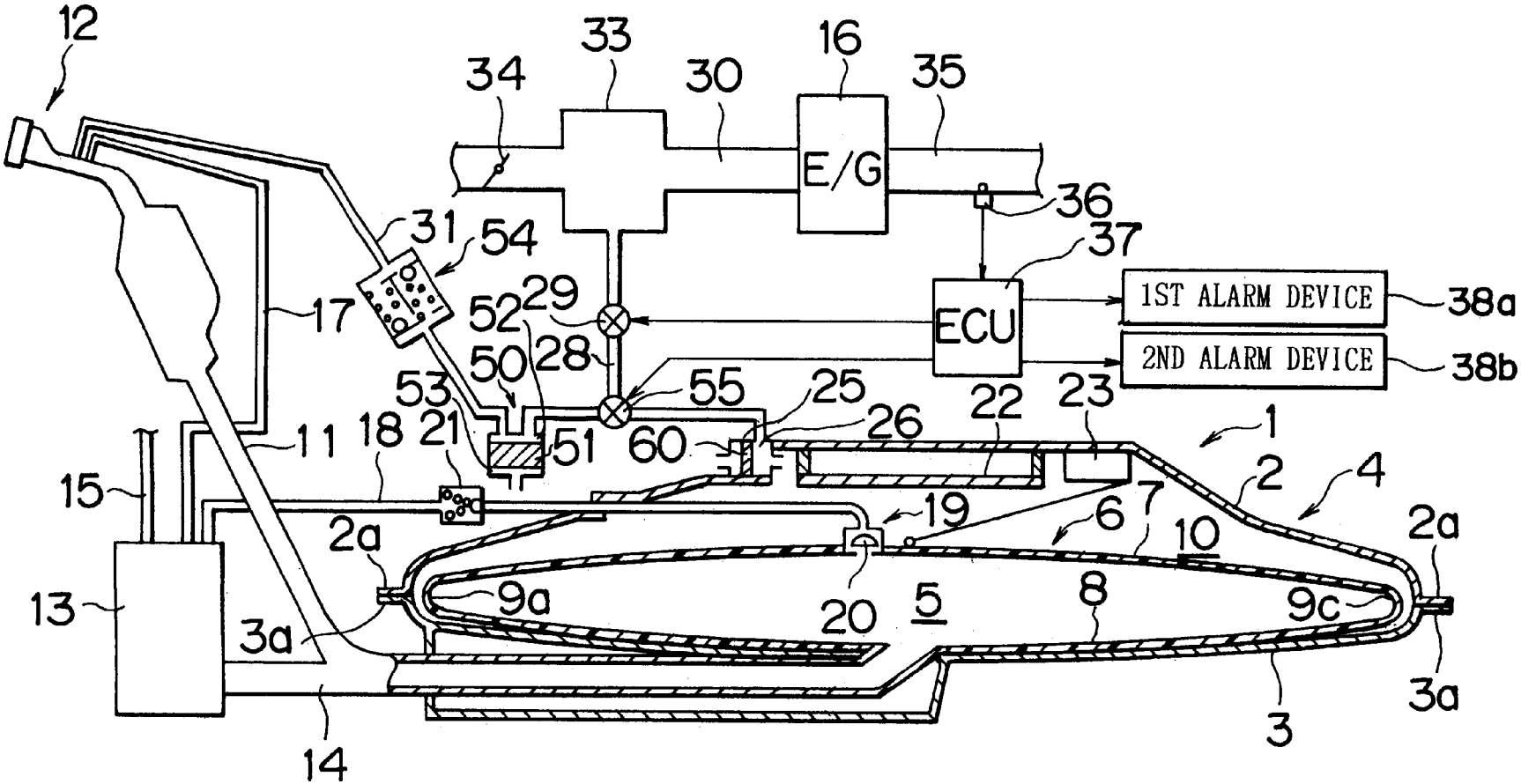
FIG. 15 illustrates a fuel storage device according to a sixth embodiment of the invention.

As shown in FIG. 15, in a fuel storage device 1 according to the sixth embodiment, a fuel supplying pipe fuel vapor discharging pipe 31 is connected to a canister fuel vapor discharging pipe 28 via a three-way valve 55. The three-way valve 55 connects a main charcoal canister 50 (and an intake passage 30) and a fuel supplying pipe 11 to each other in communication, except when the diagnostic of the fuel storage device 1 is executed. An air chamber 10 of a fuel tank 6 communicates with the atmosphere via a filter 60. The canister fuel vapor discharging pipe 28 is connected to the air chamber 10. Other constructions are substantially the same as in the second embodiment, and will not be described again.

A diagnostic operation for the fuel storage device 1 according to the sixth embodiment will be briefly described. In the sixth embodiment, if the diagnostic operation needs to be executed, the three-way valve 55 is driven to connect the air chamber 10 to the intake passage 30 in communication at the elapse of a predetermined length of time after the intake passage 30 and the intake passage 30 are connected in communication by the three-way valve 55.

If the fuel storage device 1 is normal, there is no fuel vapor in the air chamber 10. Therefore, it is determined that the fuel storage device 1 is normal, if the purged concentration is zero when the air chamber 10 is connected to the intake passage 30 in communication.

If the fuel storage device 1 has a failure due to a hole formed in a wall of the fuel tank 6, a relatively large amount of fuel vapor is present in the air chamber 10. Furthermore, even if fuel vapor has been discharged from the air chamber 10, a relatively large amount of fuel vapor per unit time occurs in the air chamber 10 due to the hole in the fuel tank 6. Therefore, it is determined that the fuel storage device 1 has a failure due to a hole formed in a wall of the fuel tank 6, if the purged concentration is higher than a predetermined purged concentration at the elapse of more than a predetermined length of time after the air chamber 10 is connected in communication to the intake passage 30.

If the fuel storage device 1 has a failure due to permeation of fuel through a wall of the fuel tank 6, a relatively large amount of fuel vapor is present in the air chamber 10. In such a case, if fuel vapor has been discharged from the air chamber 10, a relatively small amount of fuel vapor per unit time still occurs in the air chamber 10. Therefore, it is determined that the fuel storage device 1 has a failure due to permeation of fuel through a wall of the fuel tank 6, if the purged concentration exceeds the predetermined purged concentration and, at the elapse of more than the predetermined length of time, the purged concentration is lower than the predetermined purged concentration.

In the sixth embodiment, only the air chamber 10 is connected in communication to the intake passage 30 when the diagnostic of the fuel storage device 1 is executed. Therefore, the diagnostic of fuel storage device 1 is not affected by the amount of fuel vapor occurring in the fuel supplying pipe. Hence, the sixth embodiment excludes the aforementioned danger of making a false diagnosis regarding a failure of the fuel storage device 1.

Figure 16:
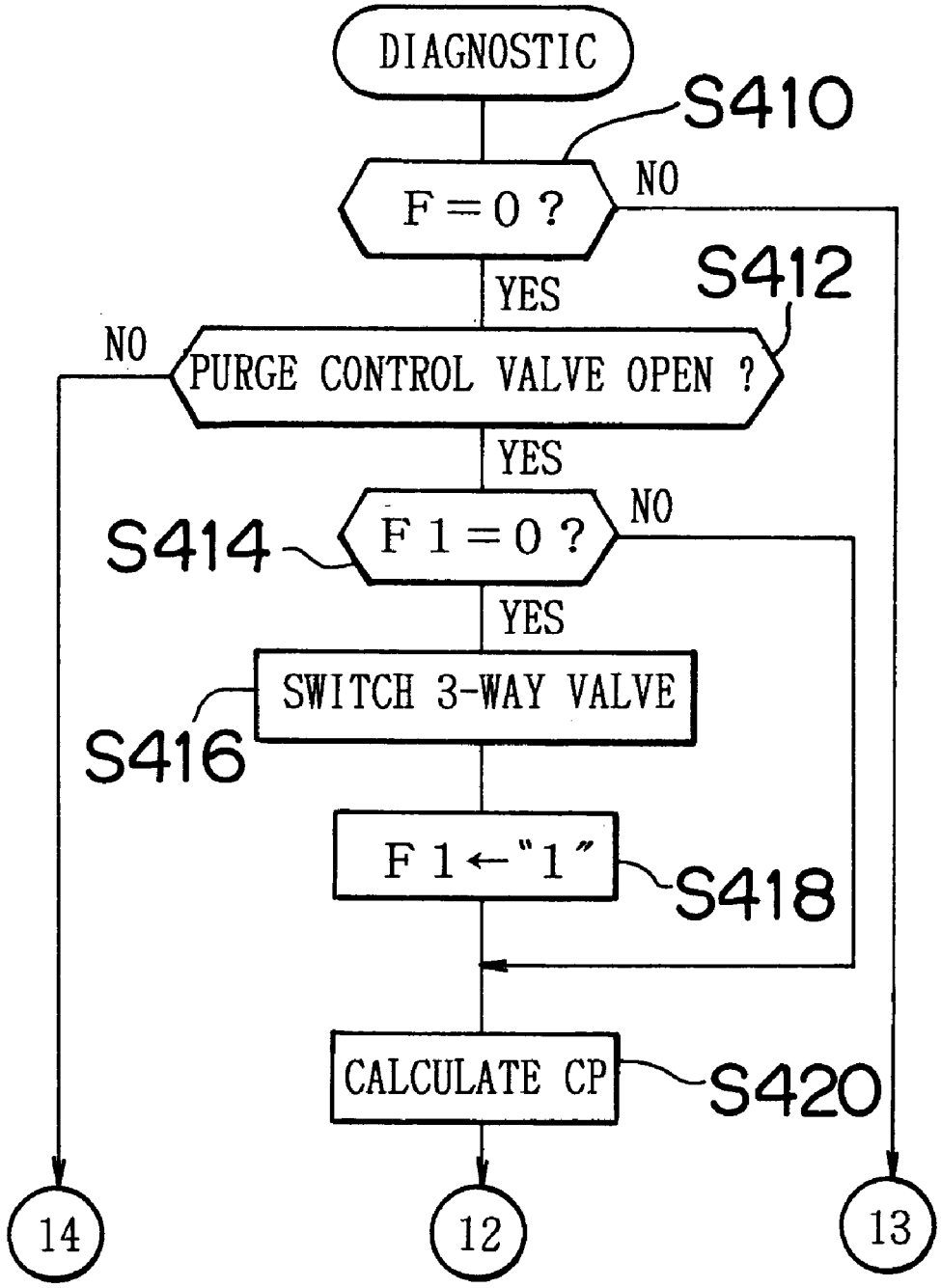
FIG. 16 is a portion of a flowchart illustrating a diagnostic operation for the fuel storage device according to the sixth embodiment.

The diagnostic operation for the fuel storage device 1 according to the sixth embodiment will be described in detail with reference to the flowchart in FIGS. 16 and 17. In step S410 in FIG. 16, it is determined whether a diagnostic execution flag F has been reset (F="0"). The diagnostic execution flag F in the sixth embodiment is substantially the same as the diagnostic execution flag F in the first embodiment. If F="0", which means that the diagnostic operation has not been executed, the operation proceeds to step S412. Conversely, if F="1" in step S410, it is determined that the diagnostic operation has been executed and completed. Therefore, the operation ends.

In step S412, it is determined whether the purge control valve 29 has been open. If the purge control valve 29 is open, it is determined that the diagnostic can be executed, and the operation proceeds to step S414. Conversely, if the purge control valve 29 is closed, it is determined that the diagnostic cannot be executed or that the diagnostic is being executed but cannot be continued. Then, the operation proceeds to step S438 in FIG. 17, in which a diagnostic execution flag F is set (F←1"). Subsequently in step S440, the three-way valve 55, presently connecting the intake passage 30 and the air chamber 10 in communication, is switched to connect the intake passage 30 and the fuel supplying pipe 11 in communication. Subsequently in step S442, a three-way valve flag F1 is reset (F1←"0"). The operation then ends. The three-way valve flag F1 is reset when the three-way valve 55 connects the intake passage 30 and the fuel supplying pipe 11 in communication. The three-way valve flag F1 is set when the three-way valve 55 connects the intake passage 30 and the air chamber 10 in communication.

In step S414, it is determined whether the three-way valve flag F1 has been reset (F1="0"). If F1="0", it is determined that the intake passage 30 and the fuel supplying pipe 11 have been connected in communication by the three-way valve 55. Then, in order to execute the diagnostic, the operation proceeds to step S416, in which the three-way valve 55 is switched to connect the intake passage 30 and the air chamber 10 in communication. Subsequently in step S418, the three-way valve flag F1 is set (F1←"1"). The operation then proceeds to step S420. Conversely, if F1="1" in step S414, it is determined that the intake passage 30 and the air chamber have already been connected in communication by the three-way valve 55. Therefore, without switching the three-way valve 55, the operation immediately proceeds to step S420. In step S420, the present purged concentration CP is calculated. The operation then proceeds to step S422 in FIG. 17. The purged concentration CP can be calculated by the same method as in the first embodiment.

Figure 17:
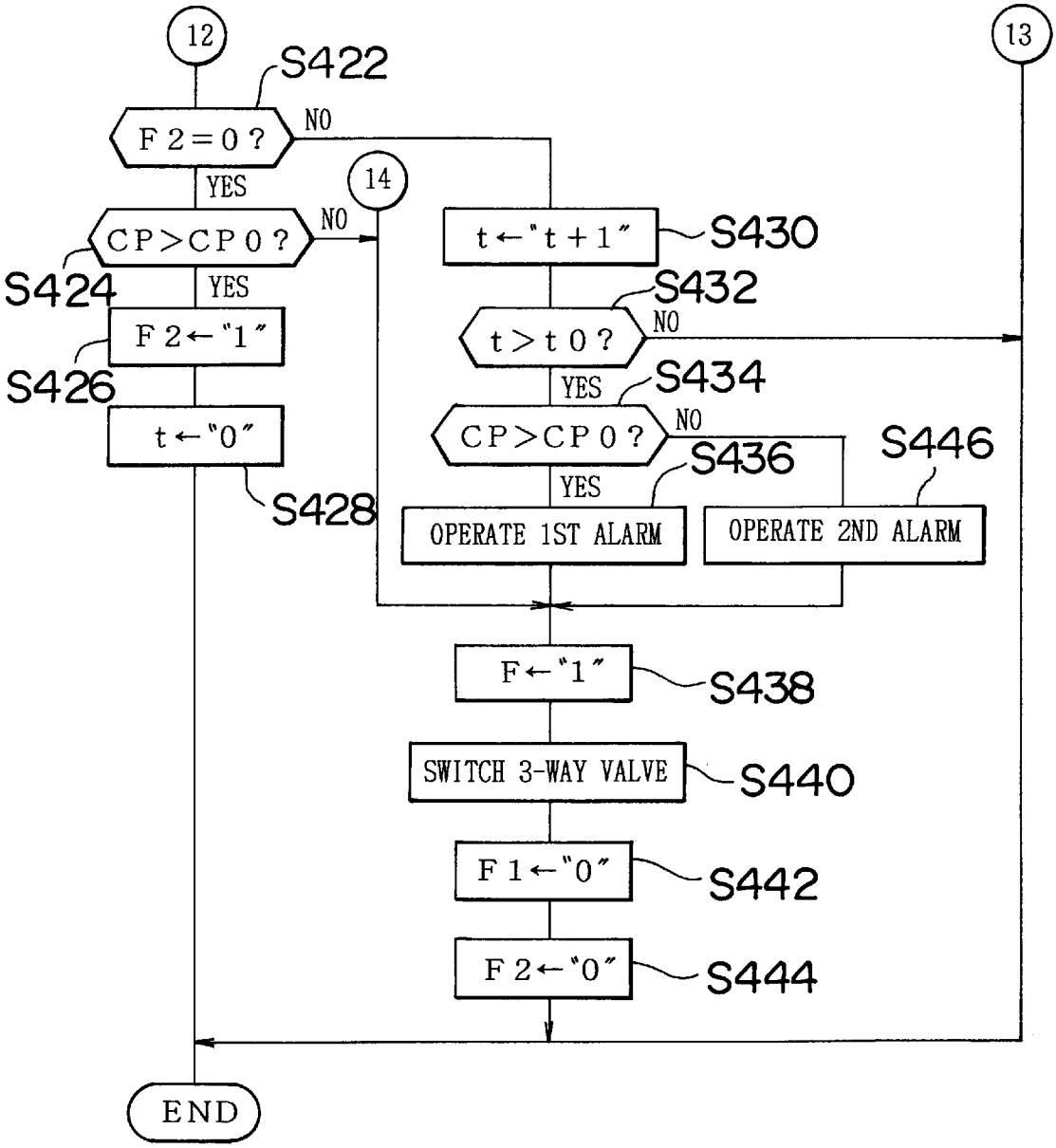
FIG. 17 is the remaining portion of the flowchart illustrating the diagnostic operation for the fuel storage device according to the sixth embodiment.

In step S422 in FIG. 17, it is determined whether a diagnostic start flag F2 has been reset (F2="0"). The diagnostic start flag F2 is a flag that is set immediately after the diagnostic starts, and that is reset when the diagnostic is completed. If F2="0" in step S422, it is determined that the present cycle is the first cycle after the diagnostic has started. Then, the operation proceeds to step S424. Conversely, if F2="1" in step S422, it is determined that the present cycle is the second or later cycle after the diagnostic has started. Then, the operation proceeds to step S430, in which the diagnostic time t is incremented by "1" (t←t+1). The operation then proceeds to step S432. The diagnostic time t is reset when the diagnostic is started. Therefore, the diagnostic time t indicates the elapsed time following the start of the diagnostic.

In step S424, it is determined whether the present purged concentration CP is higher than a predetermined purged concentration CPO (CP>CPO). If CP>CPO, it is determined that the purged concentration CP has exceeded the predetermined purged concentration CPO immediately following the connection between the intake passage 30 and the air chamber 10 in communication. The operation then proceeds to step S426, in which the diagnostic start flag F2 is set (F2="1"). Subsequently in step S428, the diagnostic time t is reset (t="0"). The operation then ends. Conversely, if CP ≦CPO in step S424, it is determined that the purged concentration CP has not exceeded the predetermined purged concentration CPO immediately following the connection between the intake passage 30 and the air chamber 10 in communication and, therefore, the fuel storage device 1 is normal. The operation then proceeds to step S438, so that the operation ends after steps S440, S442 and S444.

In step S432, it is determined whether the diagnostic time t is greater than a predetermined length of time t0 (t>t0). If t>t0, the operation proceeds to step S434, in which the purged concentration CP at the elapse of a predetermined length of time following the start of the diagnostic is compared with the predetermined purged concentration CPO. Conversely, if t≦t0 in step S432, the operation temporarily ends.

In step S434, it is determined whether the purged concentration CP at the elapse of a predetermined length of time following the start of the diagnostic is sill higher than the predetermined purged concentration CPO (CP>CPO). If CP>CPO, it is determined that the fuel storage device 1 has a hole failure because the purged concentration CP is sill higher than the predetermined purged concentration CPO despite the elapse of a predetermined length of time following the start of the diagnostic. The operation then proceeds to step S436, in which the first alarm device 38*a* is operated to notify the hole failure. The operation then proceeds to step S438, and then ends via steps S440, S442 and S444. Conversely, if CP≦CPO in step S434, it is determined that the fuel storage device 1 has a failure due to permeation of fuel through a wall of the fuel tank 6 because the purged concentration CP immediately after the start of the diagnostic was higher than the predetermined purged concentration CPO but the purged concentration CP at the elapse of the predetermined length of time following the start of the diagnostic is equal to or lower than the purged concentration CPO. The operation then proceeds to step S446, in which the second alarm device 38*b* is operated to notify the failure due to fuel permeation. The operation then proceeds to step S438, and then ends via steps S440, S442 and S444.

In step S438, the diagnostic execution flag F is set (F="1"). Subsequently in step S440, the three-way valve 55 is switched to connect the intake passage 30 and the fuel supplying pipe 11 in communication. In step S442, the three-way valve flag F1 is reset (F1="0"). In step S444, the diagnostic start flag F2 is reset (F2="0"). The operation then ends.

While the present invention has been described with reference to what are presently considered to be preferred embodiments thereof, it is to be understood that the invention is not limited to the disclosed embodiments or constructions. To the contrary, the invention is intended to cover various modifications and equivalent arrangements.

Figure 18:
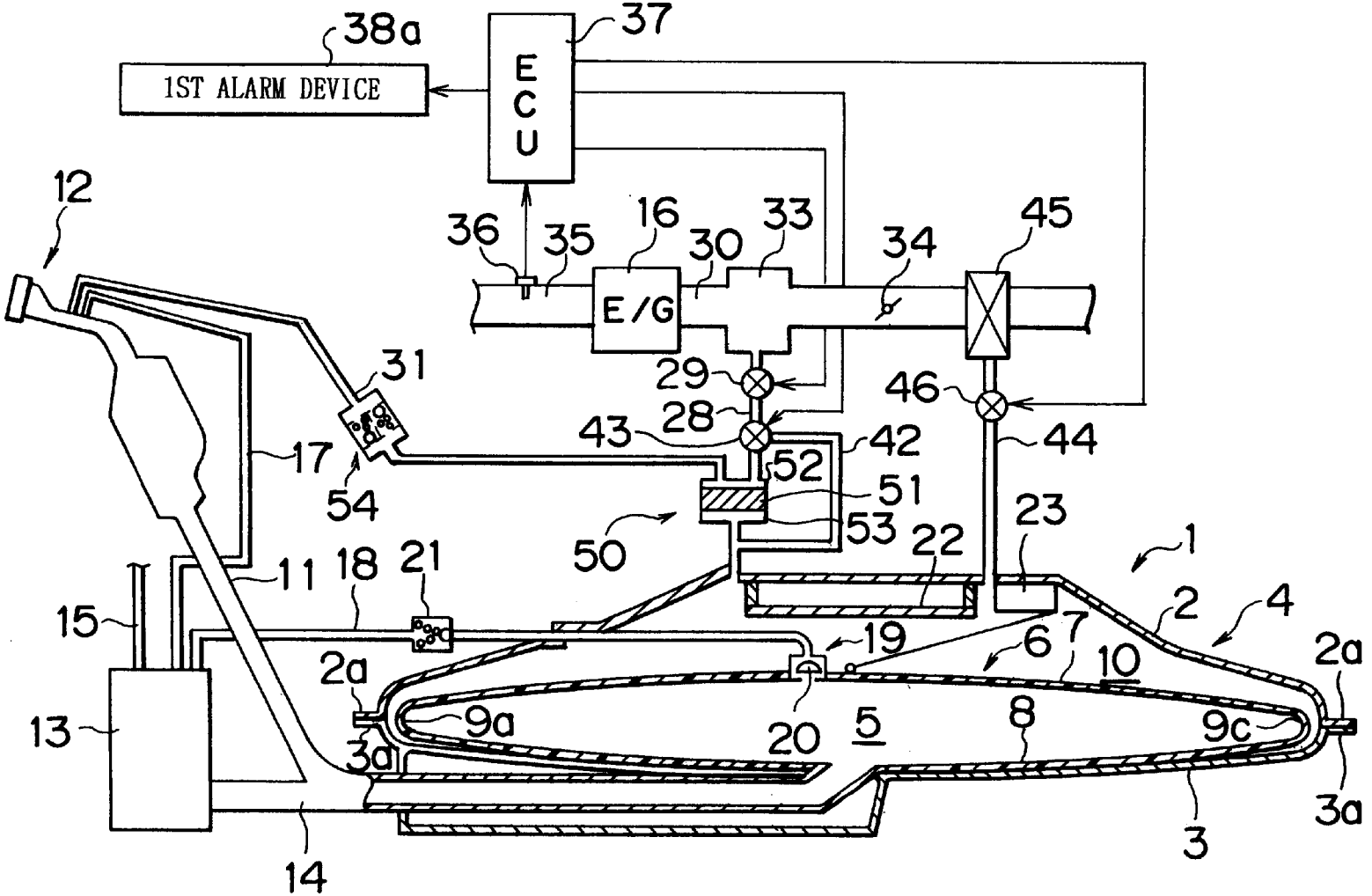
FIG. 18 illustrates a fuel storage device according to a seventh embodiment of the invention.

Referring to FIG. 18, a fuel storage device according to a seventh embodiment of the present invention will be described. Like the second embodiment of the invention, a fuel storage device 1 of this embodiment is provided with a main charcoal canister 50. In this embodiment, however, unlike the second embodiment, the atmosphere-side space 53 of the main charcoal canister 50 is connected to the air chamber 10. That is, the air chamber 10 is connected to a surge tank 33 of an intake passage 30 via the main charcoal canister 50. The air chamber 10 may be connected to the surge tank 33 via the bypass passage 42 such that the main charcoal canister 50 is bypassed. The bypass passage 42 is connected to the canister fuel vapor discharging pipe 28 via the bypass valve 43. The bypass valve 43 is disposed in the canister fuel vapor discharging pipe 28 between a purge control valve 29 and the main charcoal canister 50. The bypass valve 43 is a three-way valve that connects the air chamber 10 to the surge tank 33 via the main charcoal canister 50 or the bypass passage 42, selectively.

In this embodiment, the air chamber 10 is connected to an air filter 45 of the intake passage 30 via a connector pipe 44. An air introduction shutoff valve 46 is disposed in the connector pipe 44 so as to be shut. In this embodiment, the air chamber 10 is communicated with the atmosphere via the connector pipe 44, the air filter 45 and the intake passage 30 when the air introduction shutoff valve 46 is opened. That is, when the negative pressure is introduced into the air chamber 10, air is introduced into the air chamber 10 via the intake passage 30, the air filter 45 and the connector pipe 44.

The bypass valve 43 and the air introduction shutoff valve 46 are connected to an electronic control unit 37 that controls the operation of the bypass valve 43 and the air introduction shutoff valve 46. In this embodiment, the second alarm device 38*b* employed in the second embodiment is omitted. Except the aforementioned construction, this embodiment is the same as the second embodiment.

A diagnostic operation for the fuel storage device according to this embodiment will be described. In this embodiment, the diagnostic operation is performed during execution of purge. During execution of purge, the bypass valve 43 connects the air chamber 10 to the surge tank 33 via the main charcoal canister 50, and the air introduction shutoff valve 46 is opened. Accordingly, under purging state, the fuel vapor absorbed in the main charcoal canister 50 is mainly purged into the surge tank 33 such that air flows into the air chamber 10 from the atmosphere via the connector pipe 44. As described above, during execution of purge, the operation of the bypass valve 43 is switched to connect the air chamber 10 to the surge tank 33 via the bypass passage 42. As a result, gas within the air chamber 10 is discharged into the surge tank 33 without passing through the main charcoal canister 50. In this embodiment, the purged concentration CP is calculated when the fuel vapor absorbed in the main charcoal canister 50 is not discharged into the surge tank 33, but only gas within the air chamber 10 is discharged into the surge tank 33. If the calculated purged concentration CP is higher than a predetermined purged concentration CP2 (hereinafter referred to as a second purged concentration), it is diagnosed that the hole has been formed in the fuel tank wall.

In this embodiment, when executing the diagnostic operation, gas within the air chamber is only discharged into the surge tank. Therefore, the diagnostic operation can be performed quite accurately. That is, once the fuel vapor within the main charcoal canister or the fuel supplying pipe is discharged into the surge tank during diagnostic operation, the calculated purged concentration is likely to be affected by the fuel vapor discharged into the surge tank from the main charcoal canister or the fuel supplying pipe. In the above case, even if the calculated purged concentration is higher than a predetermined threshold value, there may be the case in which the hole has not always been formed in the fuel tank wall. On the contrary, in this embodiment, as the gas within the air chamber is only discharged into the surge tank, the calculated purged concentration is not affected by the fuel vapor discharged from the main charcoal canister or the fuel supplying pipe. As the calculated purged concentration is affected only by the fuel vapor discharged from the air chamber, the diagnostic operation with respect to the failure of the hole formed in the fuel tank wall can be accurately performed.

Figure 19:
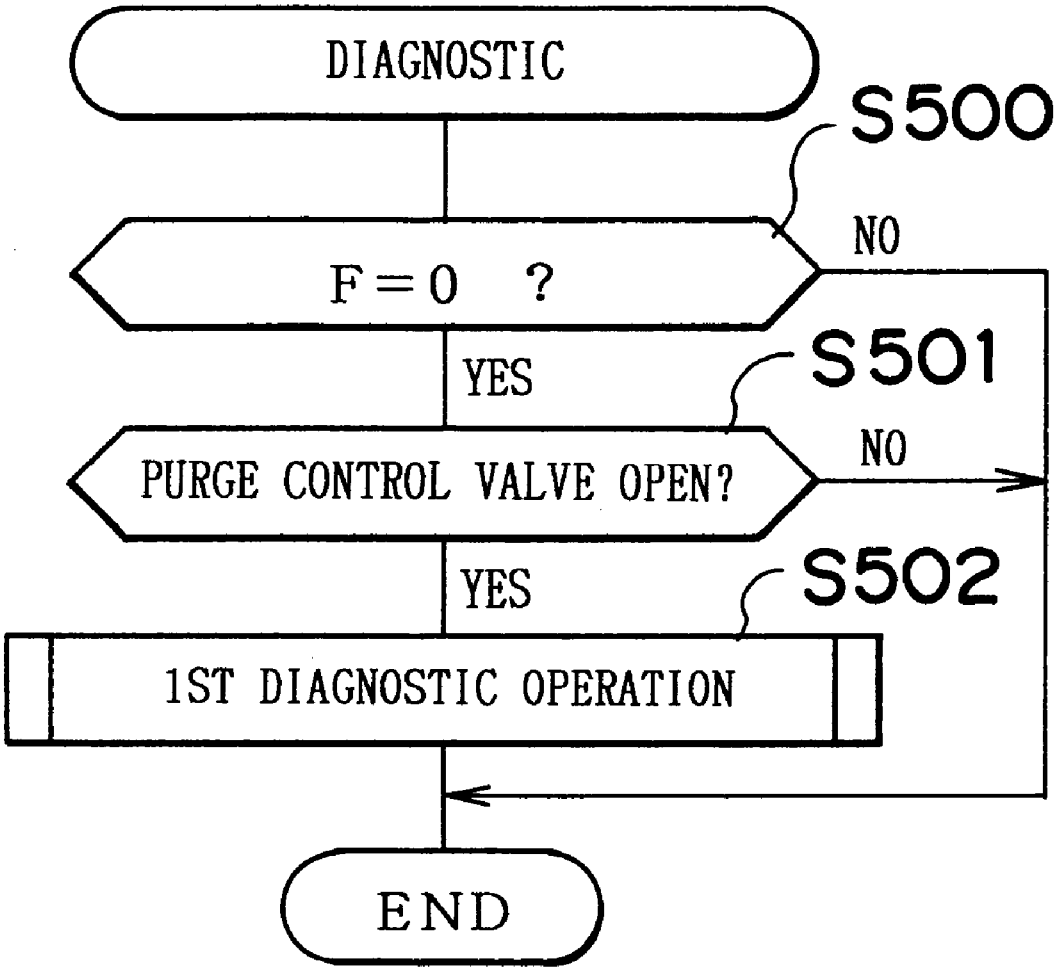
FIG. 19 is a flowchart illustrating a diagnostic operation for the fuel storage device according to the seventh embodiment.

The diagnostic operation for the fuel storage device 1 will be described in detail with reference to the flowchart in FIGS. 19 to 21. Referring first to FIG. 19, in step S500, it is determined whether a diagnostic execution flag F has been reset (F="0"). If F="0" in step S500, the operation proceeds to step S501, in which it is determined whether the purge control valve 29 is opened, that is, the purge has been executed. If F="0" in step S500 and it is further determined that the purge control valve 29 has been opened in step S501, which means that the diagnostic operation has not been executed yet, and the engine operating condition is ready for executing the diagnostic operation, the operation proceeds to step S502. In step S502, a first diagnostic operation is executed. The routine for executing the first diagnostic operation is shown in detail in FIG. 20, which will be described later in detail. Meanwhile, if F="1" in step S500, it is determined that the diagnostic operation has been already executed. If it is determined that the purge control valve 29 has not been opened in step S501, which means that the engine operating condition is not ready for executing the diagnostic operation, the operation ends.

Figure 20:
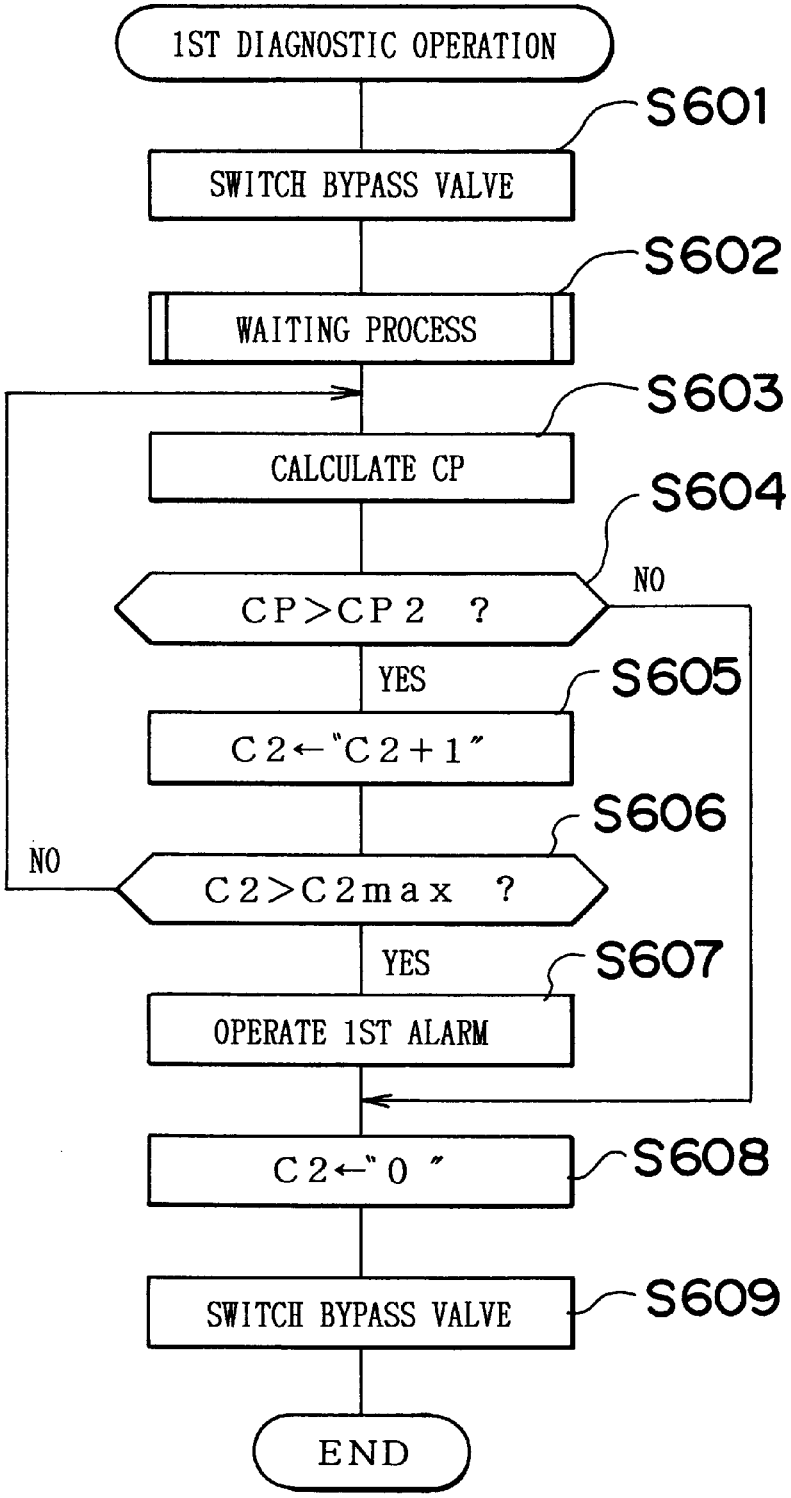
FIG. 20 is a flowchart illustrating a first diagnostic operation for the fuel storage device according to the seventh embodiment.

Referring to FIG. 20, the first diagnostic operation will be described in detail. First in step S601, the operation of a bypass valve 43 is switched such that the gas within the air chamber 10 is discharged into the surge tank 33 so as to bypass the main charcoal canister 50. Then the operation proceeds to step S602, in which the routine for the first diagnostic operation is stopped to wait for a predetermined length of time. That is, the calculation of the purged concentration is stopped until the gas within the air chamber 10 reflects the purged concentration. At the elapse of the predetermined time for keeping the routine in the waiting state, the operation proceeds to step S603, in which the purged concentration CP is calculated. The waiting operation is executed in accordance with the flowchart in FIG. 21.

In step S604, it is determined whether the purged concentration CP is higher than the second purged concentration CP2 (CP>CP2). If CP>CP2 in step S604, the operation proceeds to step S605, in which a failure counter C2 is incremented by "1", and the operation proceeds to step S606. In step S606, it is determined whether the failure counter C2 is greater than the predetermined maximum value C2max (C2>C2max). If C2>C2max in step S606, it is determined that the hole has been formed in the fuel tank wall. Then the operation proceeds to step S607, in which a first alarm device 38*a* is operated, and the operation proceeds to step S608. Meanwhile, if C2≦C2max, it is determined that it is presently inappropriate to diagnose the failure of the hole formed in the fuel tank wall, and the operation returns to step S603. The failure counter C2 is the number that represents the length of time for which the determination is made with respect to the hole formed in the fuel tank wall, or the accumulated amount of the fuel vapor that has been discharged from the air chamber 10 to the surge tank 33.

Meanwhile in step S604, if CP≦CP2, it is determined that no hole has been formed in the fuel tank wall, and the operation proceeds directly to step S608. In step S608, the failure counter C2 is reset for the diagnostic operation executed next time, and the operation of the bypass valve 43 is switched. That is, the air chamber 10 is connected to the surge tank 33 via the main charcoal canister 50, and the operation, thus, ends.

Figure 21:
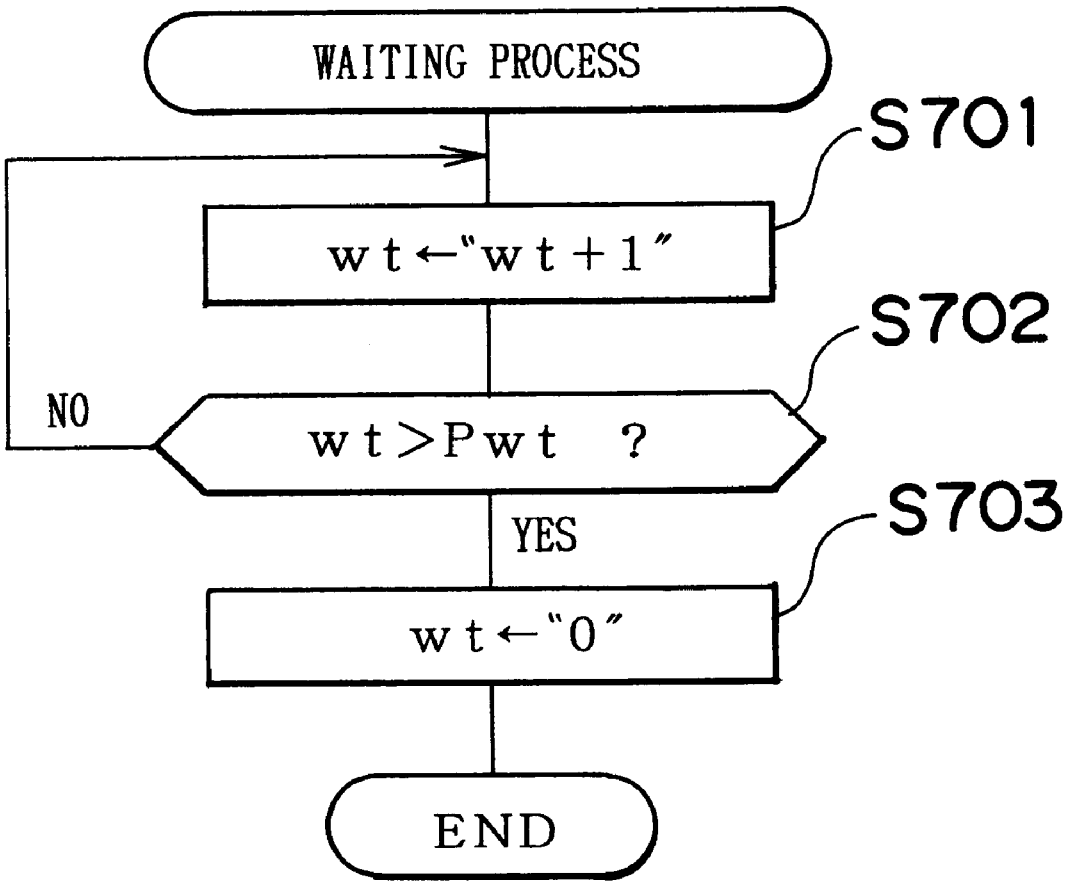
FIG. 21 is a flowchart illustrating a waiting process for the fuel storage device according to the seventh embodiment.

Referring to FIG. 21, the waiting process of this embodiment will be described in detail. First in step S701, the waiting time wt is incremented by "1". Then in step S702, it is determined whether the waiting time wt is longer than a predetermined waiting time Pwt (wt>Pwt). If wt>Pwt in step S702, it is determined that the process is kept in the waiting state for the intended period. Then the operation proceeds to step S703, in which the waiting time wt is reset. Conversely, in step S702, if wt≦Pwt, the operation returns to step S701, in which the aforementioned process is repeated until it is determined that wt>Pwt in step S702. In this embodiment, the predetermined waiting time Pwt is set to the period required to have the gas discharged from the air chamber reflecting the purged concentration after the operation of the bypass valve 43 has been switched in step S601 shown in FIG. 20 to discharge only the air within the air chamber 10.

Figure 22:
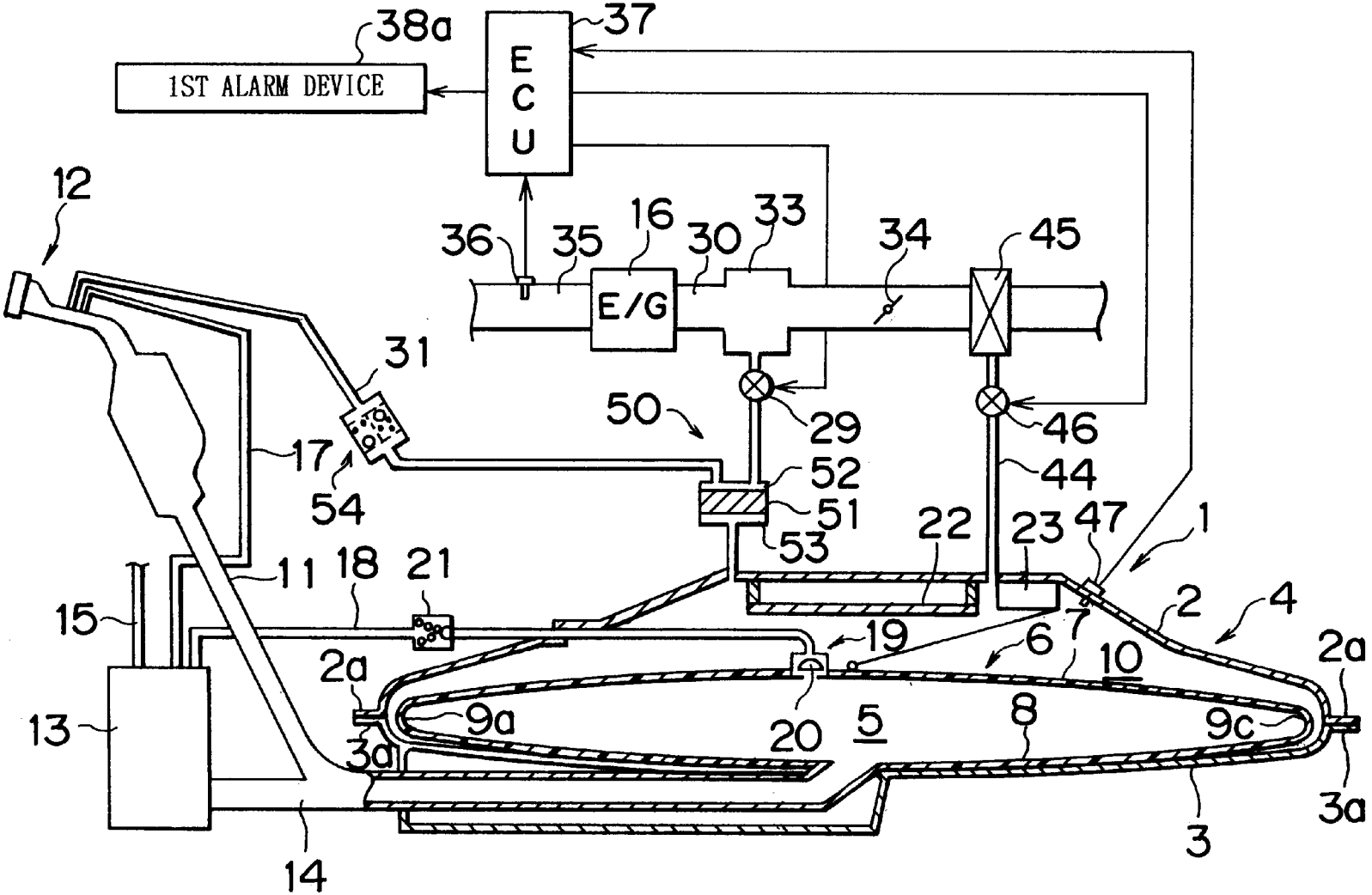
FIG. 22 illustrates a fuel storage device according to a eight embodiment of the FIG. 23 is a flowchart illustrating a diagnostic operation for the fuel storage device according to the eighth embodiment.

With respect to FIG. 22, a fuel storage device of an eighth embodiment of the present invention will be described. In this embodiment, the bypass passage 42, bypass valve 43 and the second alarm device 38*b* employed in the seventh embodiment are omitted. A pressure sensor 47 for detecting the pressure within the air chamber 10 is disposed on the upper portion 2 of the fuel storage device 1. The pressure sensor 47 is connected to the electronic control unit 37 that receives the output of the voltage corresponding to the pressure of the air chamber 10. Other constructions are substantially the same as in the seventh embodiment.

The diagnostic operation for the fuel storage device 1 according to the eighth embodiment will be described. In the eighth embodiment, the diagnostic operation is executed with respect to the failure of the hole formed in the fuel tank wall in the same way as in the seventh embodiment in the case where the amount of the fuel vapor penetrating the wall of the fuel tank 6 to flow into the air chamber 10 from the fuel chamber 5 (hereinafter referred to as the permeating fuel vapor), and the amount of the fuel vapor generated in the fuel supplying pipe 11 (hereinafter referred to as the fuel supplying pipe fuel vapor) is relatively small, and the amount of the fuel vapor absorbed in the main charcoal canister 50 is also relatively small. More specifically, purge is executed for the time sufficient to allow the fuel vapor within the main charcoal canister 50 to be discharged completely. Thereafter, the purge control valve 29 and the air introduction shutoff valve 46 are opened so as to allow the pressure sensor 47 to detect the pressure within the air chamber 10 just before or just after opening of the purge control valve 29 and the air introduction shutoff valve 46 as the initial pressure. At the elapse of a predetermined time from detection of the initial pressure, the pressure within the air chamber 10 (hereinafter referred to as the detected pressure) is detected again. If the amounts of the penetrating fuel vapor and the fuel pipe fuel vapor are relatively large, the detected pressure is relatively higher than the initial pressure. Therefore, if the difference between the detected pressure and the initial pressure is higher than the predetermined pressure difference, it is determined that each amount of the penetrating fuel vapor and the fuel supplying pipe fuel vapor is relatively small.

When the purge is executed for the period required to discharge the fuel vapor within the main charcoal canister 50 completely, it is determined that the amount of the fuel vapor absorbed in the main charcoal canister 50 is relatively small.

In the aforementioned way, the diagnostic operation with respect to the hole formed in the fuel tank wall under the uniform conditions can be executed accurately without providing the bypass passage as employed in the seventh embodiment. That is, in the seventh embodiment, the bypass passage is used to prevent the fuel vapor within the main charcoal canister 50 from affecting the purged concentration during the diagnostic operation. Meanwhile, in this embodiment under the condition where the amounts of the penetrating fuel vapor and the fuel supplying pipe fuel vapor are relatively small, if the purge has been executed for the predetermined time, the fuel vapor within the main charcoal canister 50 is completely discharged so far as no hole has been formed in the wall of the fuel tank. In other words, the fuel vapor within the main charcoal canister 50 has a substantially low possibility to affect the purged concentration even if the bypass passage is not employed. Therefore, according to the present invention, the diagnostic operation can be accurately executed without forming the bypass passage.

The diagnostic operation of this embodiment is substantially the same as that of the seventh embodiment. Unlike the seventh embodiment in which the air introduction shutoff valve 46 is opened, in this embodiment, the air introduction shutoff valve 46 is closed during the diagnostic operation. The aforementioned structure of this embodiment eliminates the air introduced into the air chamber 10 during the diagnostic operation. Therefore, the fuel vapor flowing into the surge tank 33 of the intake passage 30 is not thinned by air. As a result, the purged concentration fluctuates to the greater degree when the hole has been formed in the wall of the fuel tank 76, thus allowing the accurate diagnostic operation.

Figure 23:
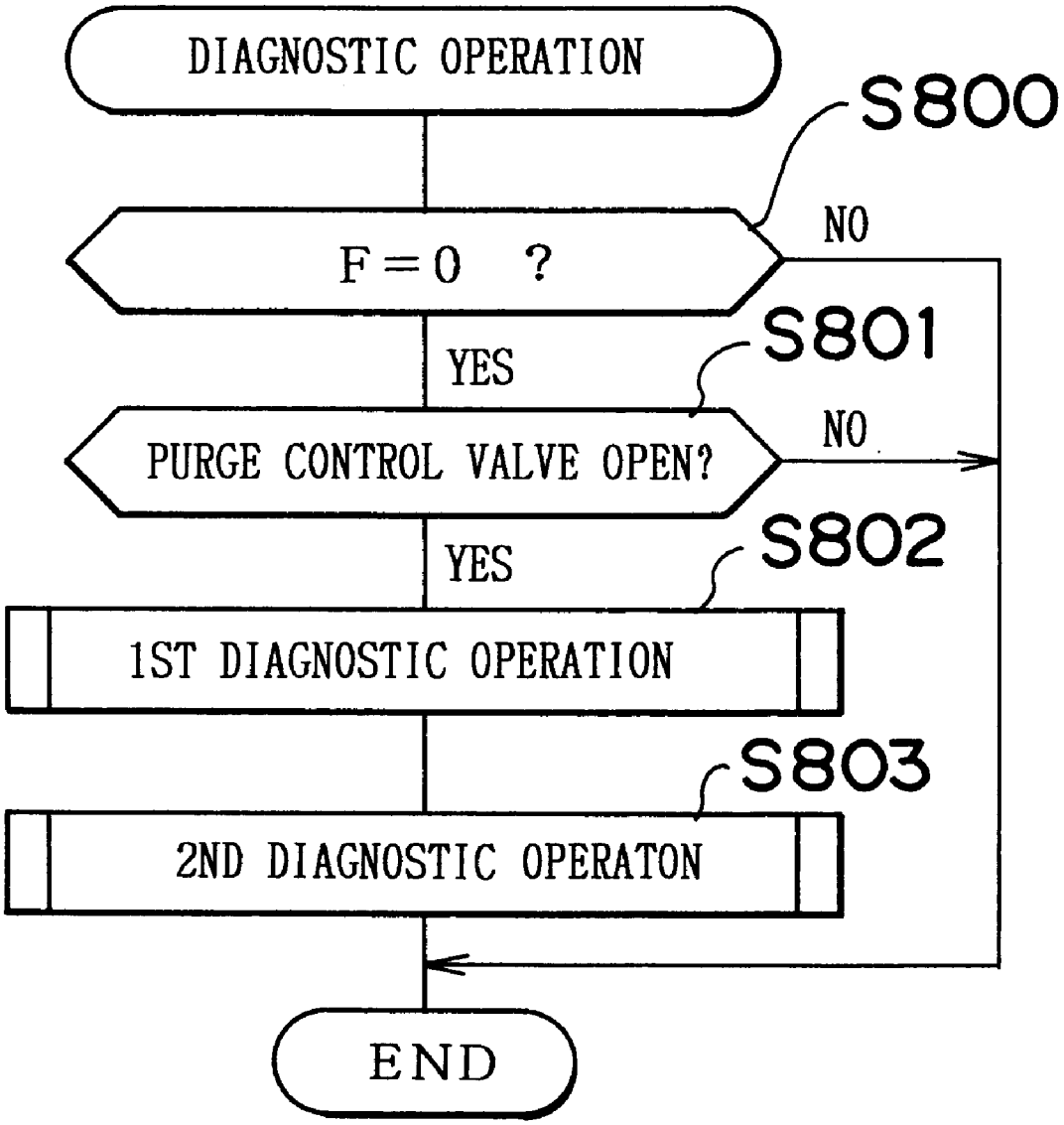
Figure 24:
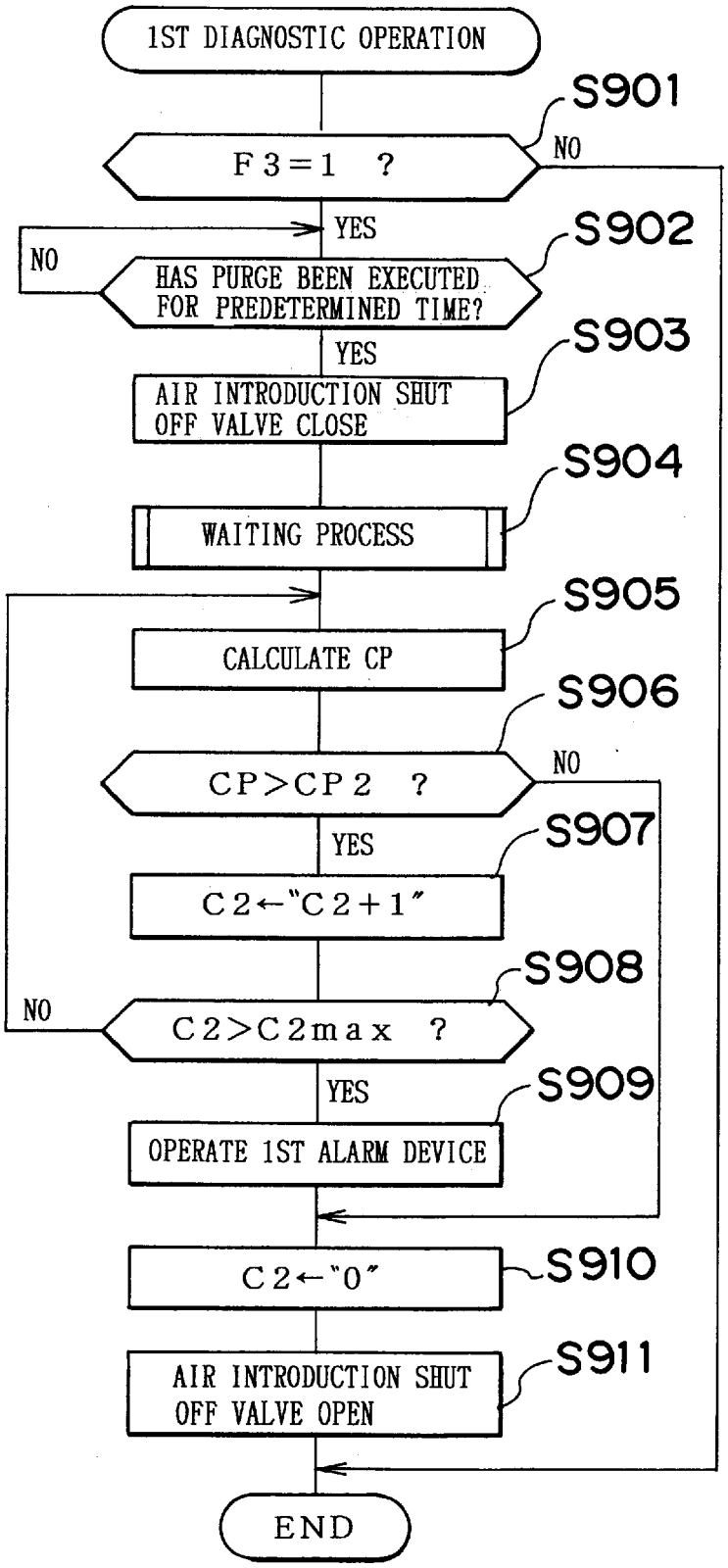
FIG. 24 is a flowchart illustrating a first diagnostic operation for the fuel storage device according to the eighth embodiment.
Figure 25:
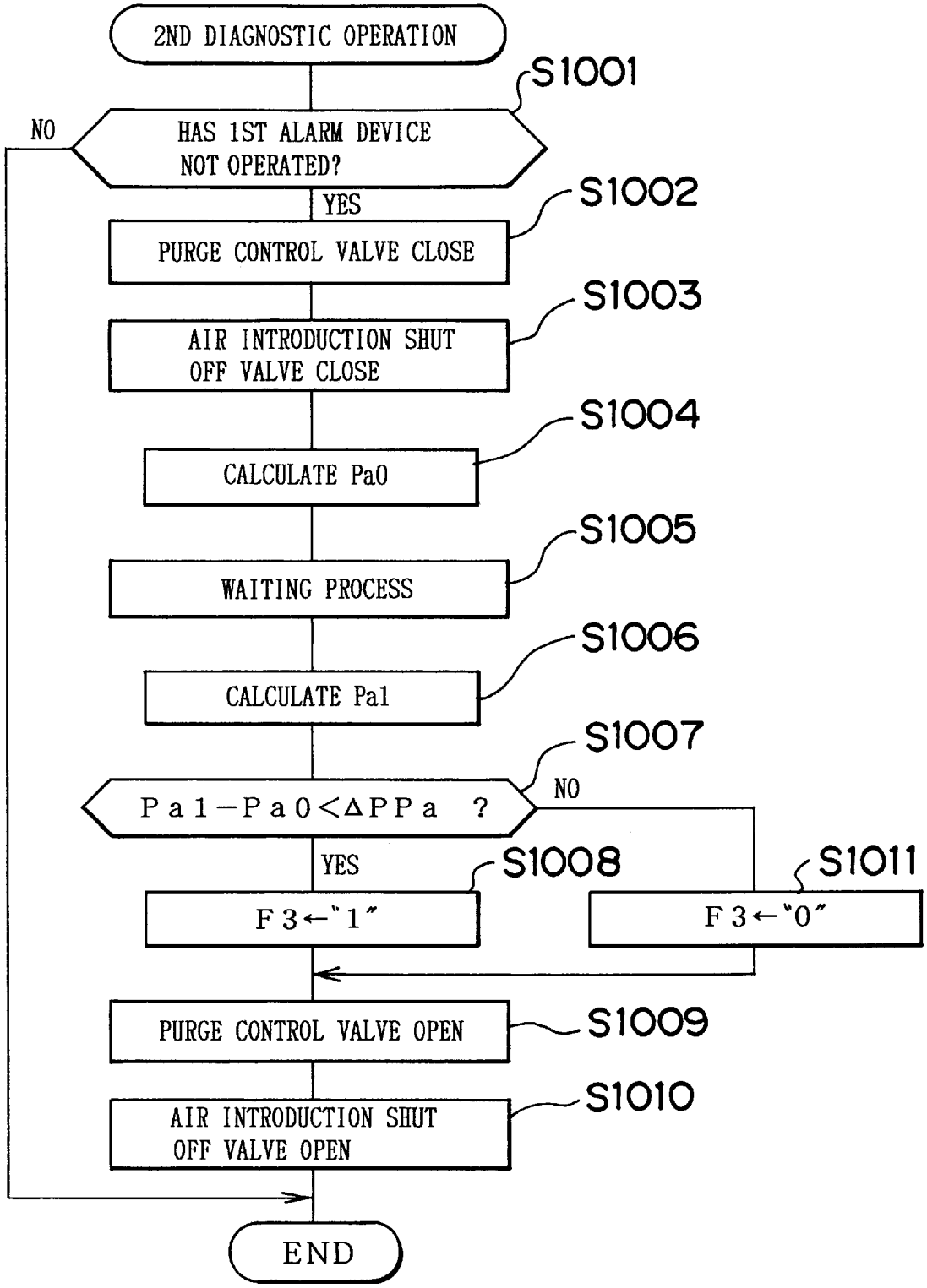
FIG. 25 is a flowchart illustrating a second diagnostic operation for the fuel storage device according to the eighth embodiment.
Figure 26:
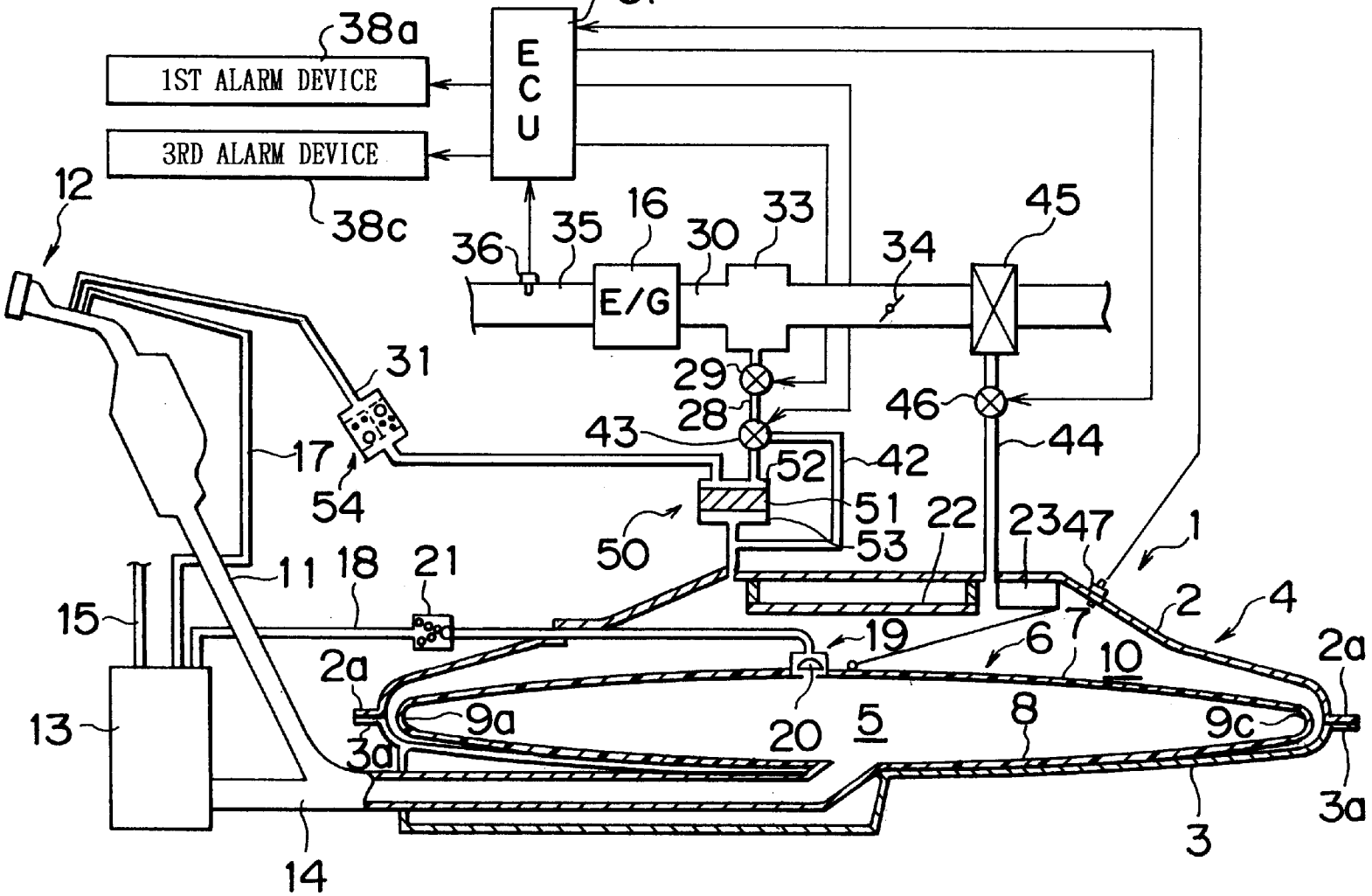
FIG. 26 illustrates a fuel storage device according to a ninth embodiment of the invention.

Then the diagnostic operation in the eighth embodiment will be described in detail referring to the flowchart in FIGS. 23 to 25. Referring first to FIG. 23, in step S800, it is determined whether the diagnostic execution flag F has been reset (F="0"). If F="0" in step S800, the operation proceeds to step S801, in which it is determined whether the purge control valve 29 has been opened, that is, the purge is being executed. If F="0" in step S800 and it is determined that the purge control valve 29 has been opened in step S801, which means that the diagnostic operation has not been executed yet and the engine operating condition is ready for the diagnostic operation, the operation proceeds to step S802, in which the first diagnostic operation is executed. In this embodiment, after the first diagnostic operation has been executed for the next first diagnostic operation, the operation proceeds to step S803, in which a second diagnostic operation is executed. FIGS. 24 and 25 show the first diagnostic operation and the second diagnostic operation in detail, respectively.

If F="1" in step S800, it is determined that the diagnostic operation has been already executed. The operation further proceeds to step S801. If it is determined that the purge control valve 29 has not been opened in step S801, which means the engine operating condition is not ready for the diagnostic operation, the operation ends.

Referring to FIG. 24, the first diagnostic operation will be described in detail. First in step S901, it is determined whether the fuel vapor flag F3 has been set (F3="1"). During the second diagnostic operation to be described later, the fuel vapor flag F3 is set when each amount of the penetrating fuel vapor and the fuel supplying pipe fuel vapor is smaller than the predetermined amount, and it is reset when each amount is greater than the predetermined amount. However, the fuel vapor flag F3 is set when the second diagnostic operation has never been executed. If F3="1" in step S901, that is, each amount of the penetrating fuel vapor and the fuel supplying pipe fuel vapor is relatively small, it is determined that the diagnostic operation can be executed with respect to the failure of the hole formed in the fuel tank wall. The operation, then, proceeds to step S902. Meanwhile, if F3="0" in step S901, that is, each amount of the penetrating fuel vapor and the fuel supplying pipe fuel vapor is relatively large, it is determined that the diagnostic operation cannot be executed with respect to the hole formed in the fuel tank wall. Then, the operation ends.

In step S902, it is determined whether the purge has been executed for the predetermined time. If it is determined that the purge has been executed for the predetermined time, which means that the fuel vapor within the main charcoal canister 50 has been completely discharged, the operation proceeds to step S903. In step S903, the air introduction shutoff valve 46 is closed, and the operation proceeds to step S904, in which the same waiting process as that shown in FIG. 21 is executed. The predetermined waiting time Pwt for the waiting process executed in step S904 is set to the period required to have the gas discharged from the air chamber 10 reflecting the purged concentration after closing the air introduction shutoff valve 46 in step S903.

Then the operation further proceeds to step S905, in which the purged concentration CP is calculated. Then in step S906, it is determined whether the purged concentration CP is higher than the second purged concentration CP2 (CP>CP2). If CP>CP2 in step S906, the operation proceeds to step S907, in which the failure counter C2 is incremented by "1". Then in step S908, it is determined whether the failure counter C2 is greater than the predetermined maximum value C2max (C2>C2max). If C2>C2max, it is determined that the hole has been formed in the fuel tank wall. The operation proceeds to step S909, in which the first alarm device 38*a* is operated and the operation further proceeds to step S910. Meanwhile, if C2≦C2max in step S904, which means that it is presently inappropriate to determine the failure of the hole formed in the fuel tank wall, the operation returns to step S905.

If CP≦CP2 in step S904, it is determined that no hole has been formed in the fuel tank wall, and the operation proceeds directly to step S910. In step S910, the failure counter C2 is reset for the next diagnostic operation, and the air introduction shutoff valve 46 is opened. Then the operation ends.

Referring to FIG. 25, the second diagnostic operation will be described in detail. First in step S1001, it is determined whether the first alarm device 38*a* has not been operated. If it is determined that the first alarm device 38*a* has not been operated, which means that no hole has been formed in the fuel tank wall at the present timing, and the second diagnostic operation can be executed, that is, the determination can be made whether each amount of the penetrating fuel vapor and the fuel supplying pipe fuel vapor is small, the operation proceeds to step S1002. If it is determined that the first alarm device 38*a* has been operated in step S1001, which means that the second diagnostic operation cannot be executed, the operation ends.

In step S1002, the purge control valve 29 is closed. In step S1003, the air introduction shutoff valve 46 is closed. Finally in step S1004, the pressure within the air chamber is detected as the initial pressure Pa0 by the pressure sensor 47.

Next in step S1005, the same waiting process as shown in FIG. 21 is executed. The predetermined waiting time Pwt in the waiting process in step S1005 is set to the period required to fluctuate the pressure within the air chamber 10 enough to execute the second diagnostic operation using the penetrating fuel vapor and the fuel supplying pipe fuel vapor after closing the purge control valve 29 and the air introduction shutoff valve 46 in steps S1002 and S1003, respectively.

In step S1006, the pressure within the air chamber 10 is detected by the pressure sensor 47 as the detected pressure Pa1. In step S1007, it is determined whether the difference between the detected pressure Pa1 and the initial pressure Pa0 is less than the predetermined pressure difference ΔPpa (Pa1−Pa0<ΔPPa). If Pa1−Pa0<ΔPPa in step S1007, it is determined that each amount of the penetrating fuel vapor and the fuel supplying pipe fuel vapor is relatively small, and the operation proceeds to step S1008. In step S1008, the fuel vapor flag F3 is set and the operation further proceeds to step S1009. Meanwhile, if Pa1−Pa0≧ΔPPa in step S1007, it is determined that each amount of the penetrating fuel vapor and the fuel supplying pipe fuel vapor is relatively large, and the operation proceeds to step S1011. In step S1011, the fuel vapor flag F3 is set and the operation further proceeds to step S1009.

In step S1009, the purge control valve 29 is opened, and then in step S1010, the air introduction shutoff valve 46 is opened.

Referring to the flowchart in FIGS. 23 to 25, in the case where it is diagnosed that no hole has been formed in the fuel tank wall in the present first diagnostic operation, the second diagnostic operation is executed for the next first diagnostic operation. However, the second diagnostic operation may be executed using the routine different from that of the first diagnostic operation.

Figure 29:
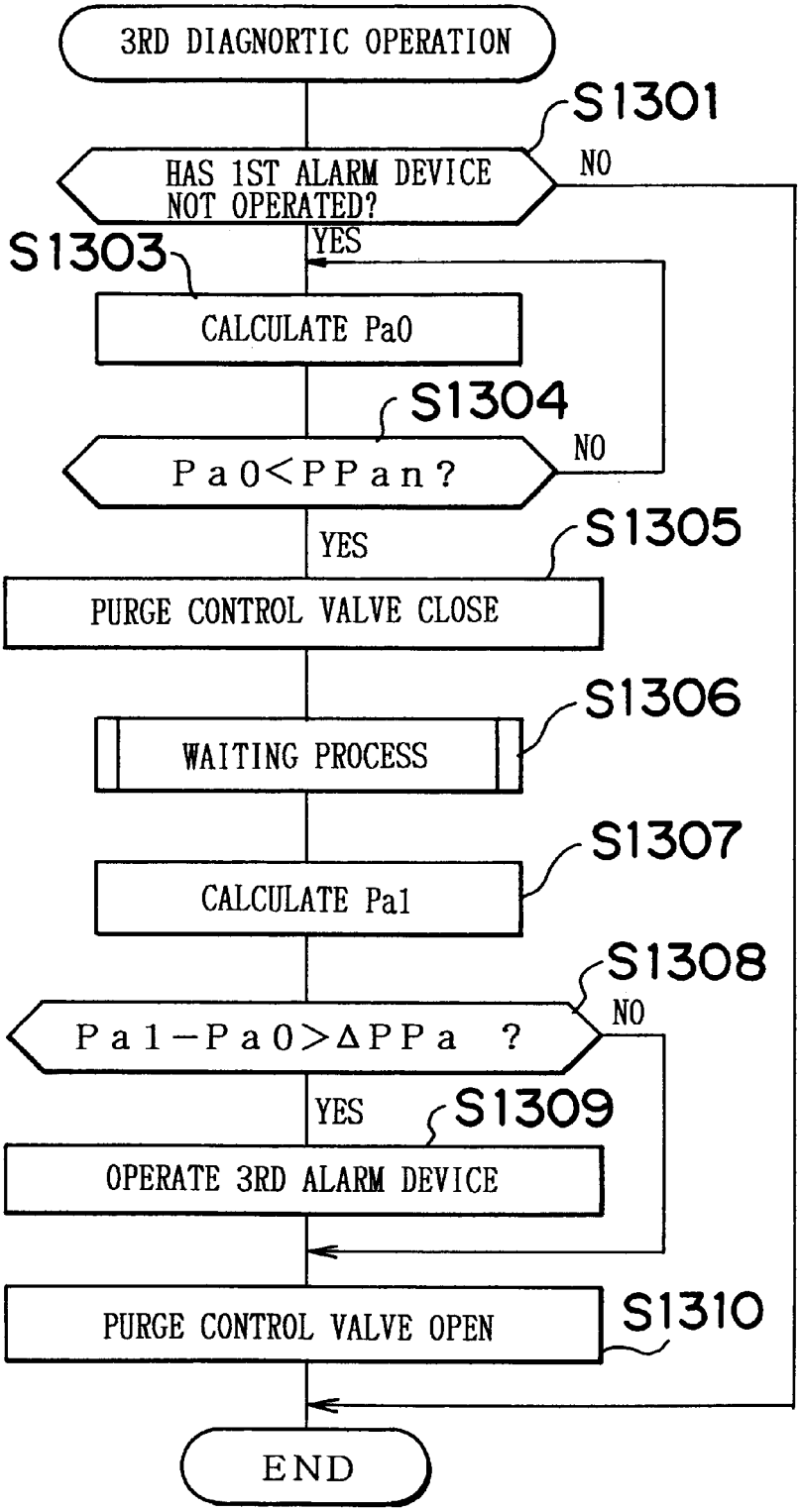
FIG. 29 is a flowchart illustrating a third diagnostic operation for the fuel storage device according to the ninth embodiment.

Referring to FIG. 29, next described will be a fuel storage device according to a ninth embodiment of the invention. A fuel storage device 1 of the ninth embodiment is provided with a third alarm device 38*c* connected to the electronic control unit 37. A pressure sensor 47 for detecting the pressure within the air chamber 10 is disposed on the upper portion 2 of the fuel storage device 1. The pressure sensor 47 is connected to the electronic control unit 37 which receives an output of the voltage corresponding to the pressure within the air chamber 10. Other constructions of this embodiment are the same as those of the seventh embodiment.

The diagnostic operation of this embodiment will be described. In this embodiment, a third diagnostic operation is added to the first diagnostic operation with respect to the failure of the hole formed in the fuel tank wall. The third diagnostic operation diagnoses the hole in the wall to form the space that allows the fuel vapor to flow therethrough, for example, the hole formed in the upper portion 2 and the lower portion 3 of the fuel storage device 1, and the hole formed in various pipes such as the fuel vapor discharge pipe.

Specifically, in this embodiment, the first diagnostic operation is executed in the same way as in the seventh embodiment after closing the air introduction shutoff valve 46. This prevents the fuel vapor from being thinned by fresh air flowing into the air chamber 10, resulting in highly accurate diagnostic operation. If it is diagnosed that no hole has been formed in the fuel tank wall in the first diagnostic operation, the third diagnostic operation is started. In the third diagnostic operation, the air introduction shutoff valve 46 is kept closed in the state where the first diagnostic operation has diagnosed that there is no hole formed in the fuel tank wall, and purge is continuously executed to turn the pressure within the air chamber 10 to the negative pressure. Then, the purge control valve 29 is closed for sealing so as to keep the pressure within the air chamber 10 negative. At an elapse of a predetermined time from closing the purge control valve 29, when the pressure within the air chamber 10 increases to exceed the predetermined value, it is diagnosed that the hole has been formed in the wall of the fuel storage device 1 except the fuel tank 6.

According to the ninth embodiment, the hole formed in the fuel tank wall and the hole formed in the wall of the fuel storage device except the fuel tank wall can be diagnosed by executing the diagnostic operation only once. Therefore, the time for executing those two types of diagnostic operations can be shortened. Furthermore, the time for interrupting execution of purge by opening the purge control valve 29 can also be shortened.

Figure 27:
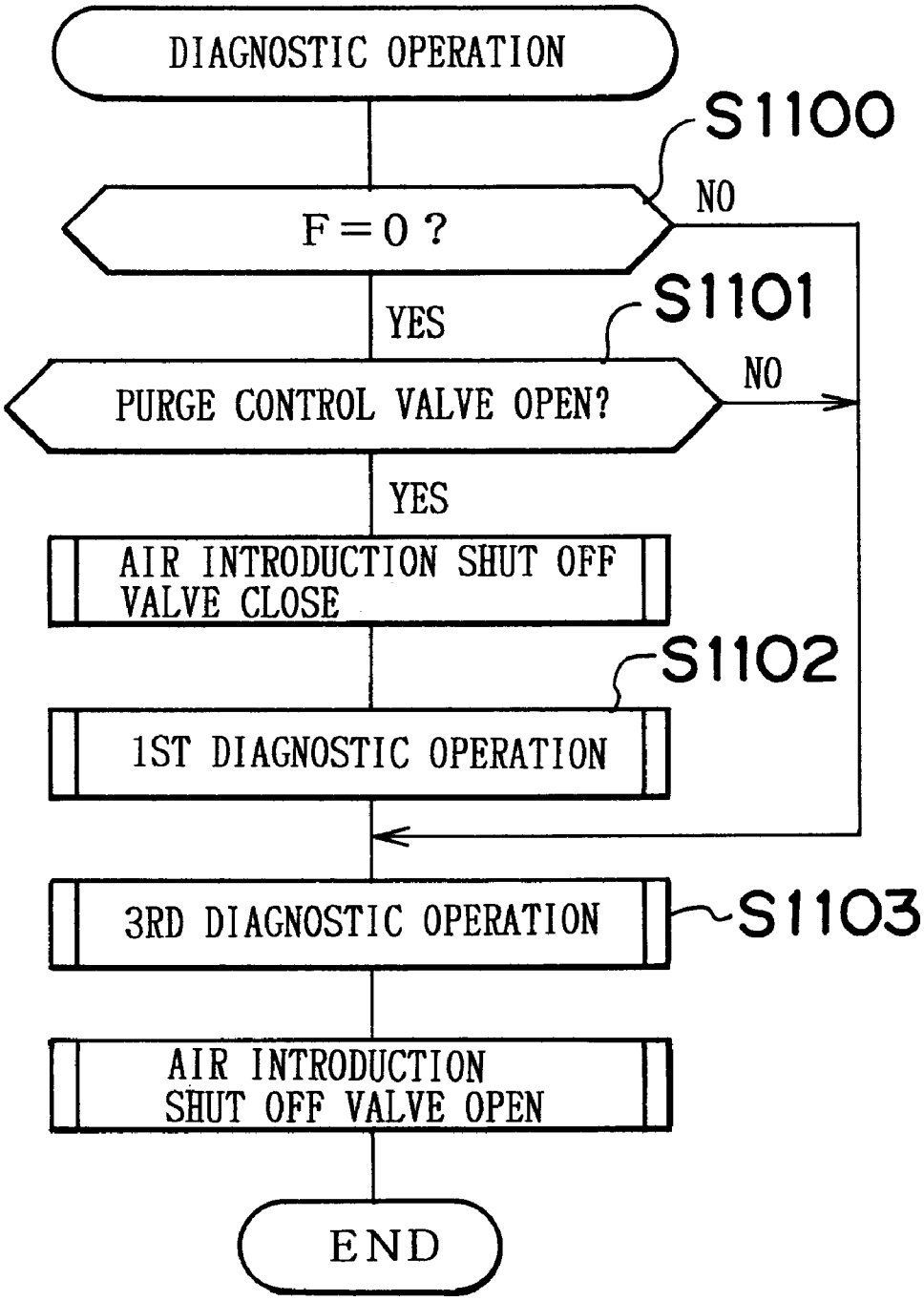
FIG. 27 is a flowchart illustrating a diagnostic operation for the fuel storage device according to the ninth embodiment.

Then the diagnostic operation of the ninth embodiment will be described in detail referring to the flowchart in FIGS. 27 to 29. Referring first to FIG. 27, in step S1100, it is determined whether the diagnostic execution flag F has been reset (F="0"). If F="0" in step S1100, the operation proceeds to step S1101, in which it is determined whether the purge control valve 29 has been opened, that is, the purge has been under execution. If F="0" in step S1100 and it is determined that the purge control valve 29 has been opened in step S1101, which means that the diagnostic operation has not been executed yet and the engine operating condition is ready for the diagnostic operation, the operation proceeds to step S1102. In step S1102, the air introduction shutoff valve 46 is closed such that the first diagnostic operation is executed. In this embodiment, after executing the first diagnostic operation, the operation proceeds to step S1103, in which the third diagnostic operation is executed. Thereafter, the air introduction shutoff valve 46 is opened. The routine for the first diagnostic operation is shown in the flowchart of FIG. 28, and the routine for the third diagnostic operation is shown in the flowchart of FIG. 29, respectively.

If F="1" in step S1100, it is determined that the diagnostic operation has already been executed. If it is determined that the purge control valve 29 has not been opened in step S1101, which means that the engine operating condition is not ready for executing the diagnostic operation, the operation ends.

Figure 28:
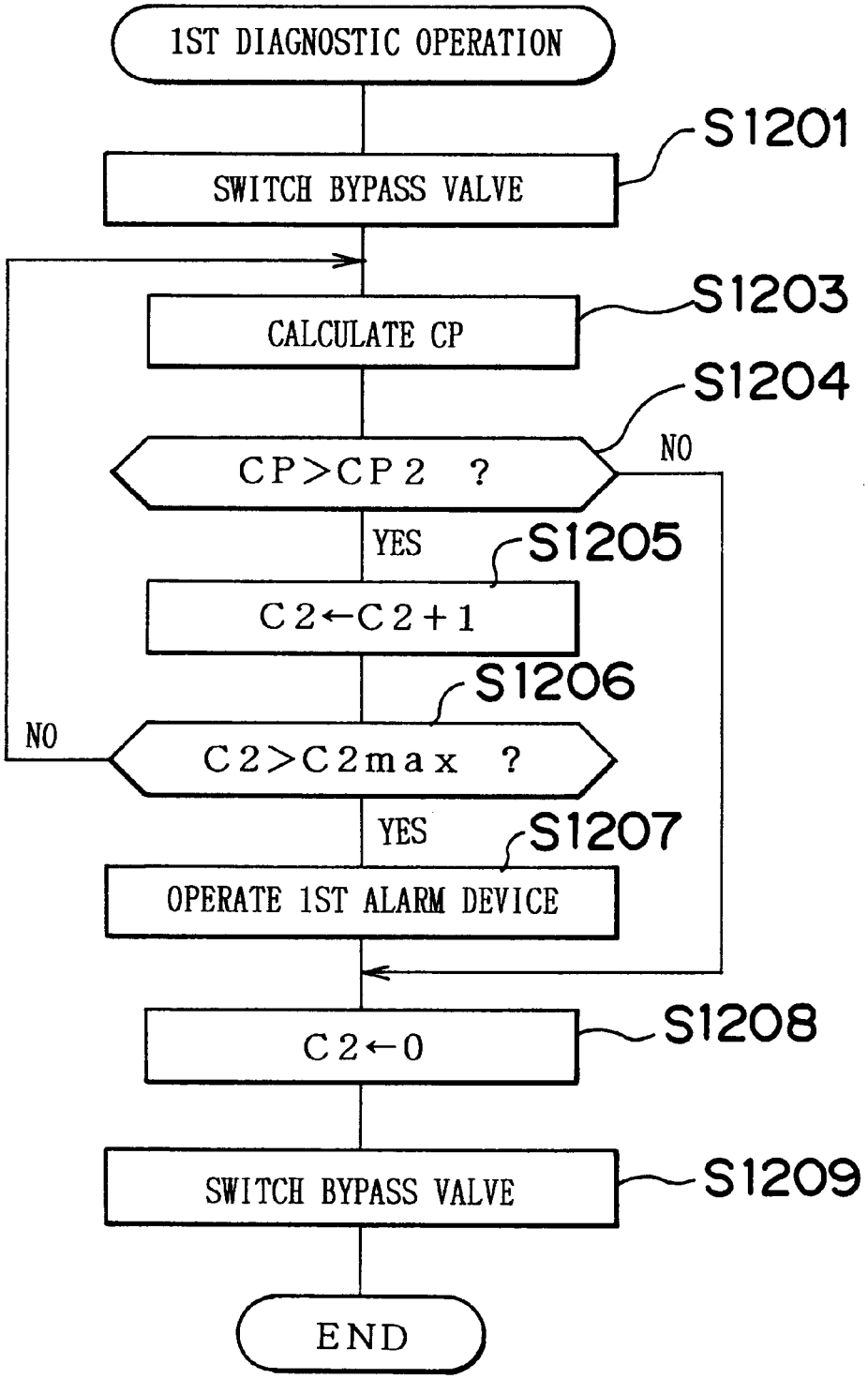
FIG. 28 is a flowchart illustrating a first diagnostic operation for the fuel storage device according to the ninth embodiment.

Referring to FIG. 28, the first diagnostic operation will be described in detail. First in step S1201, the operation of the bypass valve 43 is switched such that the gas within the air chamber 10 bypasses the main charcoal canister 50 to be discharged into the surge tank 33.

The operation further proceeds to step S1203, in which the purged concentration CP is calculated. Then in step S1204, it is determined whether the purged concentration CP is higher than the second purged concentration CP2 (CP>CP2). If CP>CP2 in step S1204, the operation proceeds to step S1205, in which the failure counter C2 is incremented by "1". Then n step S1206, it is determined whether the failure counter 2 is greater than a predetermined maximum value C2max (C2>C2max). If C2>C2max in step S1206, it is determined that the hole has been formed in the fuel tank wall, and the operation proceeds to step S1207. In step S1207, the first alarm device 38*a* is operated and the operation proceeds to step S1208. Meanwhile, if C2≦C2max in step S1206, it is determined that it is presently inappropriate to execute the diagnostic operation with respect to the hole in the fuel tank wall, and the operation returns to step S1203.

If CP≦CP2 in step S1204, it is determined that the hole has not been formed in the fuel tank wall, then the operation proceeds directly to step S1208. In step S1208, the failure counter C2 is reset for the next diagnostic operation. Next in step S1209, the operation of the bypass valve 43 is switched such that the air chamber 10 is connected to the surge tank 33 via the main charcoal canister 50. Then the operation ends.

Referring to FIG. 29, the routine for the third diagnostic operation will be described in detail. First in step S1301, it is determined whether the first alarm device 38*a* has not been operated. If it is determined that the first alarm device 38*a* has not been operated, it can be diagnosed that no hole has been formed in the fuel tank wall, and accordingly, the third diagnostic operation has to be executed with respect to the hole formed in the wall of the fuel storage device except the fuel tank 6. The operation proceeds to step S1302. If it is determined that the first alarm device 38*a* has been operated instep S1301, it is diagnosed that the third diagnostic operation does not have to be executed, and then the operation ends.

In step S1302, the air introduction shutoff valve 46 is closed. Then in step S1303, the pressure within the air chamber 10 is detected by the pressure sensor 47 as the initial pressure Pa0. The operation further proceeds to step S1304, in which it is determined whether the initial pressure Pa0 is less than a predetermined negative pressure PPan (Pa0≦PPan). If Pa0≦PPan in step S1304, the operation proceeds to step S1305. Meanwhile, if Pa0≧PPan in step S1304, the operation returns to step S1303, in which the routine is repeated until it is determined that Pa0<PPan in step S1304.

In step S1305, the purge control valve 29 is closed, then in step S1306, the same waiting process as shown in FIG. 21 is executed. The predetermined waiting time Pwt in the waiting process executed in step S1306 is set to the period enough to allow the pressure within the air chamber 10 to fluctuate so as to execute the third diagnostic operation after closing the purge control valve 29 in step S1305.

In step S1307, the pressure within the air chamber 10 is detected by the pressure sensor 47 as the detected pressure Pa1. Then in step S1308, it is determined whether the difference between the detected pressure Pa1 and the initial pressure Pa0 is higher than the predetermined pressure difference ΔPPa (Pa1−Pa0>ΔPPa). If Pa1−Pa0>ΔPPa in step S1308, it is diagnosed that the hole has been formed in the wall of the fuel storage device except the fuel tank 6. The operation proceeds to step S1309, in which the third alarm device 38*c* is operated. Then the operation further proceeds to step S1310. Meanwhile, if Pa1−Pa0≦ΔPPa in step S1308, it is diagnosed that the hole has not been formed in the wall of the fuel storage device except the fuel tank 6, and the operation proceeds directly to step S1310.

In step 1310, the purge control valve 29 is opened.

What is claimed is:

1. A diagnostic apparatus for a fuel storage device comprising:

a gas introducing passage that introduces a gas from a fuel storage device into an intake passage of an internal combustion engine;

a shutoff valve movable between an open state and closed state;

means for detecting an amount of a fuel component supplied to the internal combustion engine when the shutoff valve is in one of the open state and the closed state; and diagnostic means for determining, on the basis of the detected amount of the fuel component, whether a portion of the detected amount is contained in the gas introduced from the fuel storage device into the intake passage via the gas introducing passage, the diagnostic means determining that the fuel storage device has a fault when the fuel component from the fuel storage device is present in the gas introduced into the intake passage via the gas introducing passage.

2. An apparatus according to claim 1, wherein the diagnostic means determines whether a fault exists by comparing the detected amount with a predetermined amount of the fuel component.

3. An apparatus according to claim 2, wherein the diagnostic means determines that the fuel storage device has a fault when the detected amount is greater than the predetermined amount.

4. An apparatus according to claim 2, wherein the diagnostic means determines that the fuel storage device has a fault when the detected amount remains greater than the predetermined amount for a predetermined amount of time.

5. An apparatus according to claim 1, wherein the diagnostic means determines that the fuel component is present in the gas introduced into the intake passage via the gas introducing passage on the basis of a change in the detected amount after the shutoff valve is opened.

6. An apparatus according to claim 1, wherein the diagnostic means determines that the fuel component is present in the gas introduced into the intake passage via the gas introducing passage on the basis of a change in the detected amount before and after the shutoff valve is closed.

7. An apparatus according to claim 1, wherein the fuel component amount detecting means is disposed in the intake passage and detects an amount of the fuel component included in intake air to determine the detected amount.

8. An apparatus according to claim 1, wherein the fuel component amount detecting means includes an air-fuel ratio sensor disposed in an exhaust passage of the internal combustion engine, and the fuel component amount detecting means determines the amount on the basis of the air-fuel ratio detected in exhaust gas by the air-fuel ratio sensor.

9. An apparatus according to claim 1, wherein air introduction into said air chamber is shut off when said diagnostic means executes the diagnostic operation with respect to the failure in said partition.

10. An apparatus according to claim 1, wherein said diagnostic means shuts off said gas introducing passage with said shutoff valve after introducing the gas within said air chamber into said intake passage via said gas introducing passage, and thereafter, diagnostic operation is executed with respect to the failure of the fuel storage device based on a pressure within said air chamber.

11. An apparatus comprising:

a fuel storage device having a partition that divides a space in the fuel storage device into a fuel chamber and an air chamber, the partition being deformable in accordance with an amount of fuel present in the fuel chamber;

a gas introducing passage that introduces gas from the air chamber into an intake passage of an internal combustion engine;

a shutoff valve movable between an open state and a closed state;

means for detecting an amount of a fuel component supplied to the internal combustion engine when the shutoff valve is in one of the open state and the closed state; and diagnostic means for determining, on the basis of the amount detected by the fuel component amount detecting means, whether a portion of the detected amount is contained in the gas introduced from the fuel storage device into the intake passage via the gas introducing passage, and for diagnosing that the partition has a fault when the fuel component from the fuel storage device is present in the gas introduced into the intake passage via the gas introducing passage.

12. An apparatus according to claim 11, wherein the gas introducing passage also introduces a gas from the fuel chamber into the intake passage of the internal combustion engine and the shutoff valve stops introduction of the gas from one of the fuel chamber and the air chamber into the intake passage.

13. An apparatus according to claim 12, wherein the shutoff valve is a three-way valve.

14. An apparatus according to claim 11, wherein, when one of a first value of the amount of the fuel component detected after the shutoff valve is opened and a second value of the amount of the fuel component detected after the shutoff valve is closed is greater than a predetermined amount of the fuel component, the diagnostic means determines that the partition has a hole therethrough and wherein, when one of the first and second amounts is less than the predetermined amount, the diagnostic means determines that fuel has permeated through the partition from the fuel chamber.

15. An apparatus according to claim 11, wherein the diagnostic means detects the fuel component in the gas introduced into the intake passage on the basis of a change in the amount of the fuel component detected after the shutoff valve is opened.

16. An apparatus according to claim 11, wherein the diagnostic means determines that the fuel component is present in the gas introduced into the intake passage via the gas introducing passage, in the basis of a change in the amount if the fuel component detected around a timing at which the shutoff is closed.

* * * * *

UNITED STATES PATENT AND TRADEMARK OFFICE

CERTIFICATE OF CORRECTION

PATENT NO. : 6,240,908 B1
DATED : June 5, 2001
INVENTOR(S) : Yoshihiko Hyodo et al.

It is certified that error appears in the above-identified patent and that said Letters Patent is hereby corrected as shown below:

Column 3,
Line 25, after "embodiment of the" insert -- invention --.

Column 14,
Line 56, before "if" insert space.

Column 15,
Line 12, change "(F←"1)" to --(F←"1")--; change (C←"0)" to --(C←"0")--.
Line 28, change "instep" to -- in step --.

Column 16,
Line 7, change "s302" to -- S302 --.

Column 18,
Line 45, change "(F←1")" to --(F←"1")--.

Column 19,
Line 1, after "chamber" insert -- 10 --.

Column 27,
Line 5, after "Then" change "n" to -- in --.

Column 30,
Line 24, change "in" to -- on --.

Signed and Sealed this

Twelfth Day of March, 2002

*Attest:*

*Attesting Officer*

JAMES E. ROGAN
*Director of the United States Patent and Trademark Office*